US008376494B2

(12) United States Patent
Hirota et al.

(10) Patent No.: US 8,376,494 B2
(45) Date of Patent: Feb. 19, 2013

(54) IMAGE FORMING DEVICE AND IMAGE FORMING APPARATUS

(75) Inventors: Tetsuro Hirota, Hadano (JP); Masanori Horike, Yokohama (JP); Shin Kayahara, Kamaukura (JP); Osamu Endou, Yokohama (JP); Tomoko Takahashi, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 276 days.

(21) Appl. No.: 12/858,742

(22) Filed: Aug. 18, 2010

(65) Prior Publication Data

US 2011/0043589 A1 Feb. 24, 2011

(30) Foreign Application Priority Data

Aug. 20, 2009 (JP) ..... 2009-190579
Jun. 8, 2010 (JP) ..... 2010-131029

(51) Int. Cl.
*B41J 29/38* (2006.01)

(52) U.S. Cl. ..... 347/12

(58) Field of Classification Search ..... None
See application file for complete search history.

(56) References Cited

U.S. PATENT DOCUMENTS 4,755,837 A 7/1988 Schmidlin et al.
2009/0041492 A1 * 2/2009 Horike et al. ..... 399/55

FOREIGN PATENT DOCUMENTS

| | | |
|---|---|---|
| JP | 59-181370 | 10/1984 |
| JP | 63-136058 | 6/1988 |
| JP | 2-226261 | 9/1990 |
| JP | 2-52260 | 11/1990 |
| JP | 4-269563 | 9/1992 |
| JP | 2933930 | 5/1999 |
| JP | 2002-341656 | 11/2002 |
| JP | 2007-133387 | 5/2007 |

OTHER PUBLICATIONS

U.S. Appl. No. 12/707,124, filed Feb. 17, 2010, Tetsuro Hirota, et al.

* cited by examiner

*Primary Examiner* — Stephen Meier
*Assistant Examiner* — Tracey McMillion
(74) *Attorney, Agent, or Firm* — Oblon, Spivak, McClelland, Maier & Neustadt, L.L.P.

(57) ABSTRACT

An image forming device, including a toner bearer including plural linear electrodes located at a first regular pitch in a crosswise direction thereof, flying a toner on the surface thereof between the plural linear electrodes with a pulse voltage thereto to form a floating toner layer; and a substrate including plural hole-electrode combinations arranged in a longitudinal direction of the linear electrodes, each formed of a through-hole and a hole-adjacent electrode located close to the through-hole, wherein the floating toner layer is formed in an area facing the through-hole, and a toner passes through only the through-holes facing a desired image from the floating toner layer with a record on or off voltage, and the plural hole-electrode combinations are lined at a second regular pitch in a crosswise direction of the toner bearer, and the second regular pitch is an integral multiple of the first regular pitch.

17 Claims, 31 Drawing Sheets

P2: TONER PASS HOLE PITCH IN SUB-SCANNING DIRECTION

P2: TONER PASS HOLE PITCH IN SUB-SCANNING DIRECTION

IMAGE FORMING DEVICE AND IMAGE FORMING APPARATUS

BACKGROUND OF THE INVENTION

1. Field of the Invention

The present invention relates to an image forming apparatus such as a copier, a facsimile machine, and a printer, and to an image forming device for use in the image forming apparatus.

2. Discussion of the Background

There is a need for an image forming apparatus using direct recording methods without producing images having uneven image density.

Japanese published unexamined application No. 63-136058 (JP-S63-136058-A), e.g., discloses a conventional image forming apparatus forming images by a direct recording method. The direct recording method is different from an indirect electrophotographic process of forming a latent image and attaching toner thereto, and forms a toner image by a direct process of selectively attaching a toner to a dot-formed area on which a latent image is not formed on a recording material.

FIG. 1 is a schematic view illustrating a main configuration in an image forming apparatus using a conventional direct recording method. In FIG. 1, a toner bearing roller 901 bearing a toner is located so as to extend its rotational axial line from side to side therein and is rotationally driven by an unillustrated driver. A circuit substrate 903 having plural through-holes 902 therein is located below the toner bearing roller 901 bearing a toner particle T on its surface. On the circumference of the through-hole 902, a ring-shaped flying control electrode 904 is formed as an adjacent electrode surrounding the hole.

Below the circuit substrate 903, a facing electrode 906 facing the toner bearing roller 901 through the circuit substrate 903 and a sheet of recording paper 907 fed by an unillustrated feeder in a direction perpendicular to the surface of the paper on the facing electrode 906 are located. The toner bearing roller 901, e.g., bears a negatively polarized toner T on the surface thereof while grounded. Among the plural through-holes 902, e.g., when a positively polarized recording on voltage is applied to the flying control electrode 904 surrounding images holes, i.e., the through-holes 902 located at an image area on the recording paper 907, an electrostatic force is applied to the toner particle T located at a position facing the flying control electrode 904 on the toner bearing roller 901. An aggregate of the toner particles T flies from the toner bearing roller 901 in the shape of a dot and enters the through-hole 902. The toner particles T continue to fly, being attracted by an electric field formed between the flying control electrode 904 and the facing electrode 906 having a potential higher than that of the flying control electrode 904, pass the through-hole 902 and adhere to the surface of the recording paper 907. The aggregate of the toner particles T forms a dot by the adherence.

In FIG. 1, only one combination of the through-hole 902 and the flying control electrode 904 (hereinafter "hole-electrode combination") is shown, but there are plural combinations actually. For example, when a dot of 300 dpi is formed in whole area on a A4 size recording paper in its shorter side (210 mm) direction while fed along its longitudinal direction, straight-lined 2,482 dots in the main scanning direction (perpendicular to a feeding direction of the recording paper 907 as indicated by an arrow A in FIG. 2) form a line image. Therefore, 2,482 combinations of the through-hole 902 and the flying control electrode 904 are formed on the substrate 903.

In terms of downsizing the apparatus they are preferably arranged in a line, but there are gaps between adjacent dots when so arranged. Therefore, 2,482 combinations are separately located in plural lines so that gaps among dots formed in a line are filled with other dots formed in other lines. For example, in FIG. 2, 2,482 combinations the through-hole 902 and the flying control electrode 904 are separately located in 8 lines (lines A to H).

The arrangement of the flying control electrode 904 will be explained in more detail. FIG. 50 is an amplified plain view illustrating a first embodiment of the arrangement of the flying control electrode 904. A direction indicated by an arrow B in FIG. 50 is a feeding direction (sub-scanning direction) of an unillustrated sheet of recording paper. A direction indicated by an arrow A in FIG. 50 is a direction perpendicular to a feeding direction (that is, a main scanning direction) of a recording paper. In FIG. 50, 8 electrodes from line A (first line) to line H (eighth line) are formed in the main scanning direction. The flying control electrode 904 located in an electrode line has a diameter of 300 μm. The through-hole 902 having a diameter of 150 μm is formed at the center of the flying control electrode 904. In each electrode line, such combinations of the flying control electrode 904 and the through-hole 902 are lined at a pitch of 4×β in the main scanning direction. In FIG. 50, β is a dot pitch of 169.3 μm to produce images having an image resolution of 150 dpi. Therefore, in each electrode line, the "hole-electrode combinations" are located at the same pitch as a dot pitch of 150/4=37.5 dpi. From line A (first line) to line D (fourth line), as shown in FIG. 50, locations of the "hole-electrode combinations" in the main scanning direction are shifted by "β" respectively. Therefore, four lines from line A (first line) to line D (fourth line) realize a dot pitch equivalent to an image resolution of 150 dpi in the main scanning direction. The "hole-electrode combination" in line E (fifth line) is located, as shown in FIG. 50, between the "hole-electrode combination" in line A (first line) and the "hole-electrode combination" in line B (second line) in the main scanning direction. Similarly, the "hole-electrode combination" in line F (sixth line) is located between the "hole-electrode combination" in line B (second line) and the "hole-electrode combination" in line C (third line), the "hole-electrode combination" in line G (seventh line) is located between the "hole-electrode combination" in line C (third line) and the "hole-electrode combination" in line D (fourth line), and the "hole-electrode combination" in line H (eighth line) is located between the "hole-electrode combination" in line D (fourth line) and the "hole-electrode combination" in line E (fifth line), respectively. Therefore, eight lines from line A (first line) to line H (eighth line) realize a dot pitch (α=84.6 μm) equivalent to an image resolution of 300 dpi in the main scanning direction. A Pitch "γ" of electrode lines in a sub-scanning direction (arrow B direction) is four times α (=338.7 μm). Total 8 "hole-electrode combinations" of one per line form a line image of 84.6×8=676.8 μm in the main scanning direction. The shorter side of A4 is 210 mm=210,000 μm, and 210,000/676.8×8=2,482 pieces of the "hole-electrode combinations" are formed to form a line image extending over the whole area of the shorter side direction.

FIG. 51 is an amplified plain view illustrating a second embodiment of the arrangement of the flying control electrode 904. In this second embodiment, the locations of the "hole-electrode combinations" are shifted by α=84.6 μm respectively in the main scanning direction and order of lines A, B, C, D, E, F, G and H. Such electrodes arrangement realizes an image resolution of 300 dpi as well as the first embodiment. In addition, 2,482 pieces of the "hole-electrode combinations" are formed to form a line image extending over the whole area of the shorter side direction.

The direct recording method needs individually turning on and off a record-on-voltage for plural flying control electrodes 904 using dedicated ICs, which are numerous. For example, 2,482 ICs are needed to form an image having an image resolution of 300 dpi. ICs are typically more expensive as they have higher voltage resistance, and it is important to keep a record-on-voltage as low as possible in the direct recording method. However, the record-on-voltage is at least 500 v or more to form an electric field overcoming adherence between the toner bearing roller 901 and the toner particles T (such as an image force, a van der Waals' force and a liquid cross-linking force). This has hindered efforts to decrease cost.

Image forming apparatuses using hopping development methods are conventionally known. The hopping development methods use toner hopping on the surface of a toner bearer and not toner adhering to a roller or a magnetic carrier. For example, JP-2007-133387-A discloses an image forming apparatus having a cylindrical toner bearer having plural hopping electrodes located at a predetermined pitch in a circumferential direction of the toner bearer. The same repeated pulse voltage of A phase is applied to the hopping electrodes in even-numbered lines, while the same repeated pulse voltage of B phase is applied to the hopping electrodes in odd-numbered lines. An alternating electric field is formed between the two hopping electrodes next to each other to cause the toner to hop to and fro between an A phase electrode and a B phase electrode. The toner bearer rotates to feed the hopping toner T to a developing area facing a latent image bearer to develop the latent image.

The hopping development method includes a method of transferring a toner to a developing area without a rotational surface movement of the toner bearer. JP-2002-341656-A discloses an image forming apparatus transferring a toner to a developing area as follows. Namely, in the image forming apparatus, plural electrode combinations formed of three electrodes of an A phase electrode, a B phase electrode and a C phase electrode, lined up in this order, are arranged on a toner bearer in a line. On the surface of the toner bearer, toner is repeatedly made to hop from the A phase electrode to the B phase electrode, the B phase electrode to the C phase electrode, and the C phase electrode to the A phase electrode, in this order. This hopping transfers the toner from one end of the toner bearer to a developing area at the other end.

In any hopping development method, toner is caused to hop on the surface of the toner bearer to eliminate adherence between the toner and the toner bearer. JP-S59-181370-A discloses an image forming apparatus applying this principle to a direct recording method. The image forming apparatus uses a method of recording a dot by passing toner hopping on the surface of the toner bearer through an image hole in a circuit board (hereinafter referred to as a hopping direct recording method). The method largely reduces the record-on voltage. This is because the hopping eliminates adherence between the toner and the toner bearer and an electric field need not be stronger than the adherence to pass toner through the image hole in the circuit board.

However, the present inventors have found that the hopping direct recording method is likely to produce images having uneven image density because an amount of toner entering each hole on the circuit board varies. This will be explained in detail.

FIG. 52 is an amplified plain view illustrating the "hole-electrode combination" of the first embodiment in FIG. 50 with a hopping electrode 911 of a toner bearing sleeve. As shown in FIG. 52, the hopping electrode 911 for hopping a toner on the surface of the toner bearing sleeve has the shape of a reed extending in the main scanning direction (arrow A). The reed-shaped hopping electrodes 911 are arranged in multiple parallel lines at a pitch of $\delta$=250 μm in a sub-scanning direction (arrow B). The hopping electrode 911 has a width of 100 μm. The gap G between the hopping electrodes 911 is 150 μm. When a pulse voltage is applied to the hopping electrode 911, toner moves reciprocally between the hopping electrodes 911 in the sub-scanning direction.

FIG. 3 is a schematic view illustrating a main configuration of an image forming apparatus using a hopping direct recording method. In FIG. 3, plural hopping electrodes 911 arranged in parallel lines at a predetermined pitch are circumferentially formed on a toner bearing sleeve 910 as a toner bearer. The hopping electrode 911 is the same as that in FIG. 52. On the surface of the toner bearing sleeve 910, toner hops between adjacent hopping electrodes 911 in a parabolic orbit having an apogee halfway between the hopping electrodes as shown in FIG. 3. In FIG. 3, the center of the through-hole 902 in the first line (left side) is located at almost the same position of the middle of the parabolic orbit of a hopping toner, and many toner particles are present close to the through-hole 902 in the first line. Therefore, comparatively many toner particles enter the through-hole 902 in the first line. By contrast, the center of the through-hole 902 in the second line (right side) is largely offset from the middle of the parabolic orbit of the hopping toner, and few toner particles are present close to the through-hole 902 in the second line. Therefore, comparatively few toner particles enter the through-hole 902 in the second line. This large difference in the amount of a toner entering the through-hole 902 causes uneven image density.

For this reasons, a need exists for an image forming apparatus using direct recording methods without producing images having uneven image density.

SUMMARY OF THE INVENTION

Accordingly, an object of the present invention is to provide an image forming device using direct recording methods without producing images having uneven image density.

Another object of the present invention is to provide an image forming apparatus using direct recording methods without producing images having uneven image density.

These objects and other objects of the present invention, either individually or collectively, have been satisfied by the discovery of an image forming device, comprising:

a toner bearer comprising plural linear electrodes located at a first regular pitch in a crosswise direction of the toner bearer, configured to fly a toner on the surface thereof between the plural linear electrodes upon application of a pulse voltage thereto to form a floating toner layer; and a substrate comprising plural hole-electrode combinations arranged in a longitudinal direction of the linear electrodes, each formed of a through-hole and a hole-adjacent electrode located close to the through-hole, wherein the floating toner layer is formed in an area facing the through-hole and a toner passes through only the through-holes facing a desired image from the floating toner layer upon application of a record on voltage for recording a dot or a record off voltage for not recording a dot, and wherein the plural hole-electrode combinations arranged in a longitudinal direction of the linear electrodes are lined at a second regular pitch in a crosswise direction of the toner bearer, and the second regular pitch is an integral multiple of the first regular pitch.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides an image forming device using direct recording methods without producing images having uneven image density. More particularly, the present invention relates to an image forming device, comprising:

a toner bearer comprising plural linear electrodes located at a first regular pitch in a crosswise direction of the toner bearer, configured to fly a toner on the surface thereof between the plural linear electrodes upon application of a pulse voltage thereto to form a floating toner layer; and a substrate comprising plural hole-electrode combinations arranged in a longitudinal direction of the linear electrodes, each formed of a through-hole and a hole-adjacent electrode located close to the through-hole, wherein the floating toner layer is formed in an area facing the through-hole and a toner passes through only the through-holes facing a desired image from the floating toner layer upon application of a record on voltage for recording a dot or a record off voltage for not recording a dot, and wherein the plural hole-electrode combinations arranged in a longitudinal direction of the linear electrodes are lined at a second regular pitch in a crosswise direction of the toner bearer, and the second regular pitch is an integral multiple of the first regular pitch.

Figure 1:
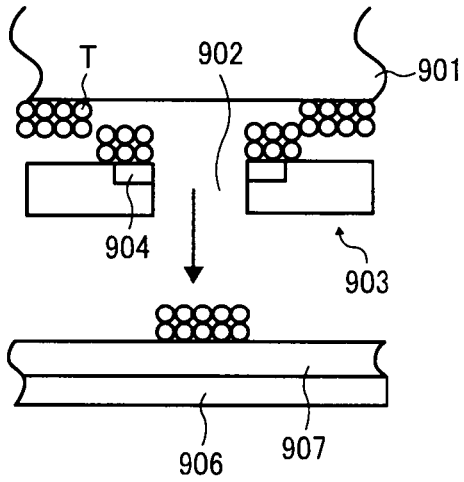
FIG. 1 is a schematic view illustrating a main configuration in an image forming apparatus using a conventional direct recording method.
Figure 2:
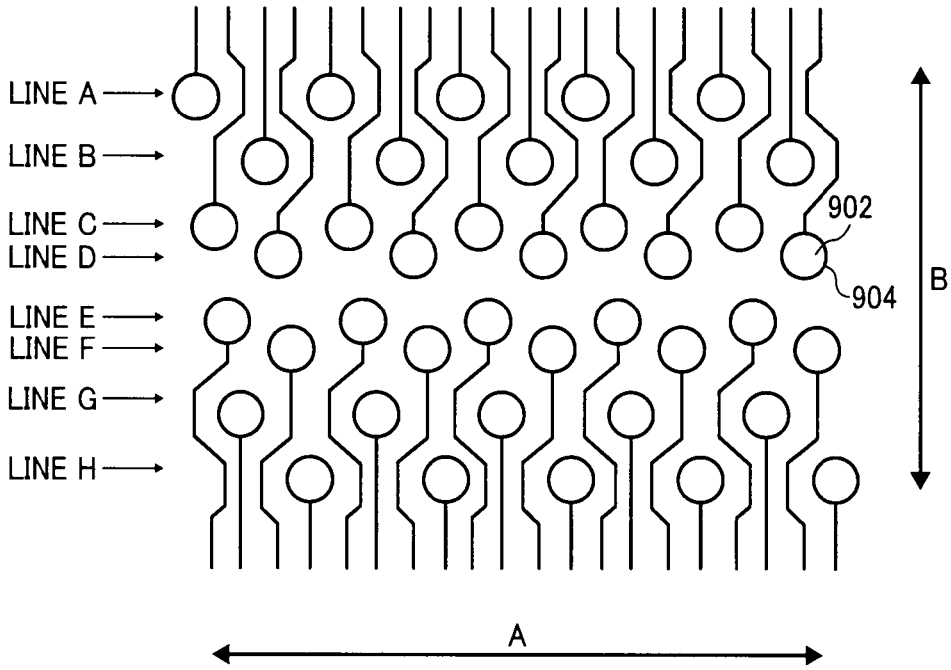
FIG. 2 is a plain view illustrating a part of a circuit board of the image forming apparatus in FIG. 1.
Figure 3:
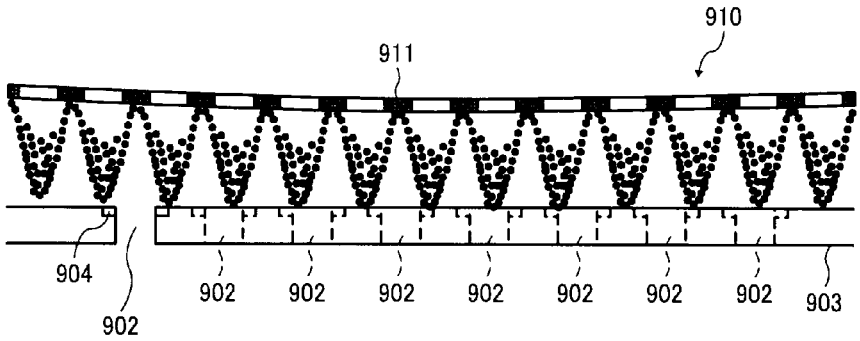
FIG. 3 is an amplified schematic view illustrating the circuit board and a toner bearing roller of the image forming apparatus in FIG. 1.
Figure 4:
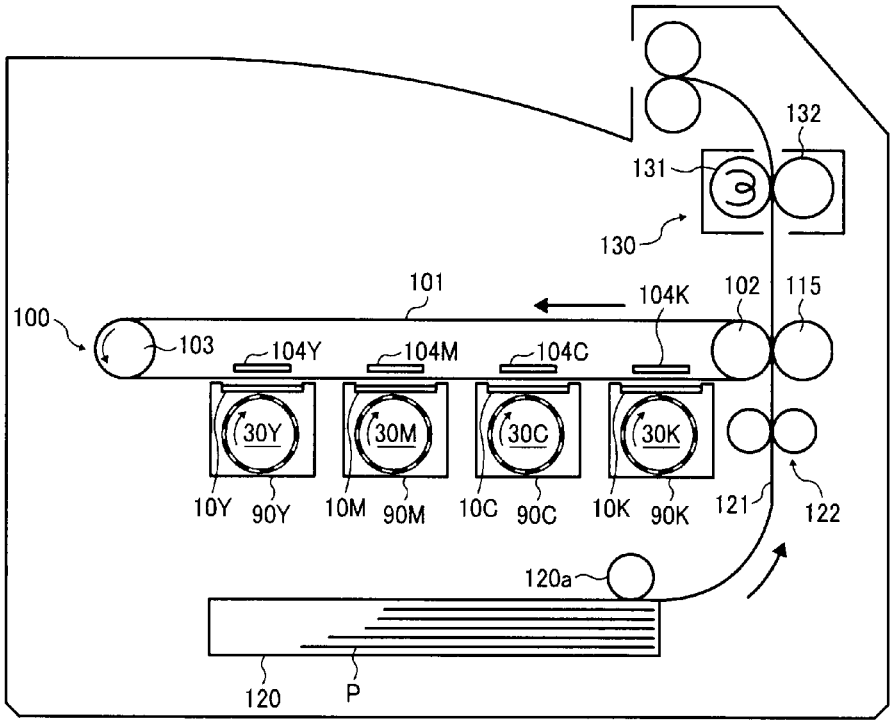
FIG. 4 is a schematic view illustrating a first embodiment of the image forming apparatus of the present invention.

Hereinafter, as the image forming apparatus using a hopping direct recoding method of the present invention, an embodiment of a (color) printer will be explained. FIG. 4 is a schematic view illustrating a first embodiment of the image forming apparatus of the present invention. The printer includes image forming devices 90Y, 90M, 90C and 90K for forming yellow images, magenta images, cyan images and black images using a yellow (Y) toner, a magenta (M) toner, a cyan (C) toner and a black (K) toner; a recoding belt driver 100; a paper feed cassette 120; a pair of registration rollers 122; a fixer 130; etc.

The image forming devices 90Y, 90M, 90C and 90K are horizontally lined at a predetermined pitch, and have circuit boards 10Y, 10M, 10C and 10K; toner bearing sleeves 30Y, 30M, 30C and 30K as toner bearers; etc. respectively.

The recoding belt driver 100 is located above the image forming devices 90Y, 90M, 90C and 90K, and has an endless intermediate recording belt 101, a drive roller 102, a driven roller 103, facing electrode plates 104Y, 104M, 104C and 104K, a belt cleaner 110, a transfer roller 115, etc. The intermediate recording belt 101 is endlessly rotated anticlockwise by the drive roller 102 rotating anticlockwise while suspended by the drive roller 102 and the driven roller 103 extensionally in a horizontal direction thereof. An outer surface (loop outer surface) of the intermediate recording belt 101 sequentially passes positions facing the image forming devices 90Y, 90M, 90C and 90K with its endless rotation. Then, a yellow (Y) toner image, a magenta (M) toner image, a cyan (C) toner image and a black (K) toner image are sequentially overlapped to form a 4-color overlapped toner image on the outer surface of the intermediate recording belt 101.

The four electrode plates 104Y, 104M, 104C and 104K of the recoding belt driver 100 are located in the loop of the intermediate recording belt 101 so as to face the circuit boards 10Y, 10M, 10C and 10K of the image forming devices 90Y, 90M, 90C and 90K through the belt. A transfer roller 115 of the recoding belt driver 100 is located out of the loop of the intermediate recording belt 101 and contacts a point of the drive roller 102 suspending the belt to form a transfer nip. In the transfer nip, a potential difference of the transfer roller 115 applied with a positive transfer bias by an unillustrated electric source and the drive roller 102 forms a transfer electric field.

A belt cleaner 110 of the recoding belt driver 100 is located so as to contact an area before entering a position facing the yellow image forming device 90Y after passing the transfer nip in all circumferential areas of the intermediate recording belt 101.

A paper feed cassette 120 contains plural overlapped recording papers P, and a paper feed roller 120*a* contacts the uppermost recording paper P. The paper feed roller 120*a* is driven to rotate at a predetermined timing to feed the uppermost recording paper P to a paper feed path 121. The recording paper P fed is sandwiched between the rollers of the pair of registration rollers 122 located just before the transfer nip. The pair of registration rollers 122 feed the recording paper P sandwiched between the rollers to the transfer nip so as to closely contact the recording paper P to a four-color overlapped toner image on the intermediate recording belt 101. The four-color overlapped toner image closely contacted in the transfer nip to the recording paper P is transferred onto the recording paper P by the transfer electric field or nip pressure to form a full-color toner image with white color of the recording paper P. The recording paper P a full-color toner image is formed on is fed from the transfer nip to a fixer 130 to fix the full-color toner image thereon and discharged out of the apparatus. The fixer 130 forms a fixing nip by a contact between a heating roller 121 including a heat source such as a halogen lamp and a pressure roller 122 pressed against the heating roller 121. When the recording paper P is sandwiched in the fixing nip, the full-color toner image is fixed on the surface of the recording paper P with a nip pressure and a heat.

The belt cleaner 110 cleans a toner remaining on the intermediate recording belt 101 after transferred in the transfer nip.

Figure 5:
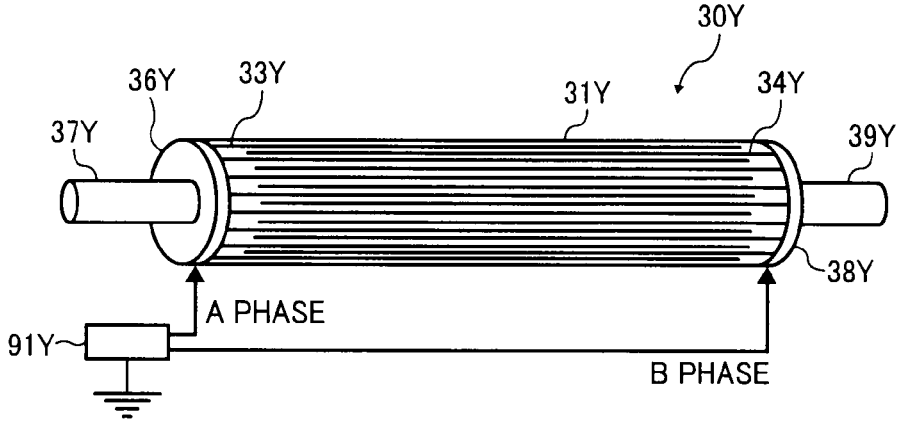
FIG. 5 is a perspective view illustrating a toner bearing sleeve of a yellow image forming device of the image forming apparatus in FIG. 4.
Figure 6:
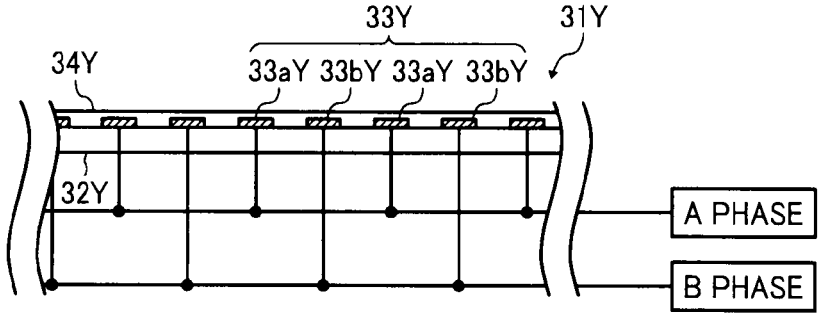
FIG. 6 is a cross-sectional view illustrating the toner bearing sleeve in FIG. 5.
Figure 7:
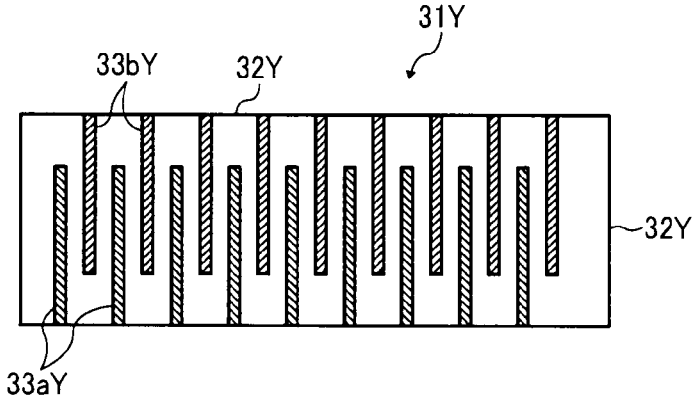
FIG. 7 is a plain development view illustrating a cylindrical part of the toner bearing sleeve in FIG. 5.

FIG. 5 is a perspective view illustrating a toner bearing sleeve 30Y of a yellow image forming device 90Y of the image forming apparatus in FIG. 4. FIG. 6 is a cross-sectional view illustrating the toner bearing sleeve 30Y. FIG. 7 is a plain development view illustrating a cylindrical part 31Y of the toner bearing sleeve 30Y. As shown in FIG. 5, the toner bearing sleeve 30Y includes the cylindrical part 31Y, flanges 36Y and 38Y respectively connected with both ends of the cylindrical part 31Y, axial members 37Y and 39Y projecting from the centers of the respective flanges, etc.

On the circumferential surface of the cylindrical part 31Y, plural electrodes 33Y extending in an axial direction of the toner bearing sleeve 30Y are formed at a predetermined pitch in line in a circumferential (rotational) direction of the cylindrical part 31Y. Every second electrode lined in the circumferential (rotational) direction is electrically an in-phase electrode having a same potential each other. Specifically, as shown in FIGS. 6 and 7, on the circumferential surface of the cylindrical part 31Y, an A phase electrode 33*a*Y which is a first hopping electrode and a B phase electrode 33*b*Y which is a second hopping electrode are alternately lined in the circumferential direction. The A phase electrode 33*a*Y extends to an end of the cylindrical part 31Y in an axial direction thereof, and the metallic flange 36Y is connected with the end of the cylindrical part 31Y as shown in FIG. 5. The plural A phase electrodes 33*a*Y are electrically conductive each other with the flange 36Y. The B phase electrode 33*b*Y extends to the other end of the cylindrical part 31Y in the axial direction, and the metallic flange 38Y is connected therewith. The plural A phase electrodes 33*b*Y are electrically conductive each other with the flange 38Y.

The toner bearing sleeve 30Y in FIG. 5 is rotationally driven while the axial members 37Y and 39Y in an axial direction of the toner bearing sleeve 30Y are rotationably supported. A feed controller 91Y applies a periodic pulse voltage for A phase hopping to the flange 36Y. An unillustrated electrode charges the flange 36Y while frictionally contacting thereto. The periodic pulse voltage for A phase hopping, applied to the flange 36Y is introduced to the plural A phase electrodes 33*a*Y, respectively. The feed controller 91Y applies a periodic pulse voltage for B phase hopping to the flange 38Y. An unillustrated electrode charges the flange 38Y while frictionally contacting thereto. The periodic pulse voltage for B phase hopping, applied to the flange 38Y is introduced to the plural B phase electrodes 33*b*Y, respectively.

Figure 8:
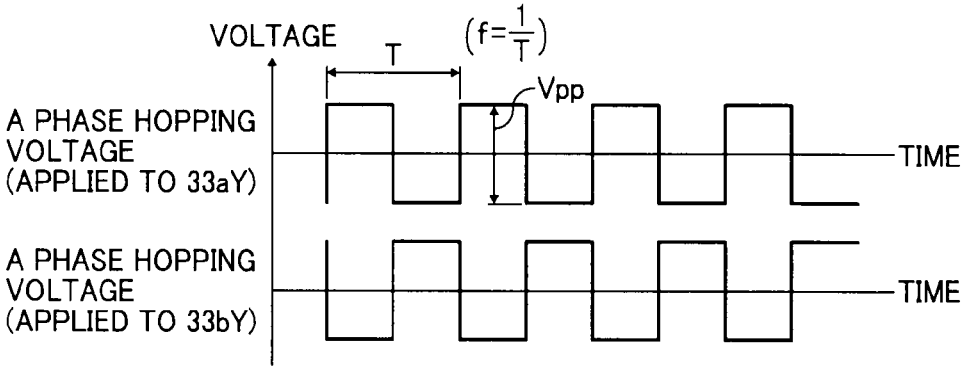
FIG. 8 is a diagram showing waveforms of an A phase hopping voltage applied to an A phase electrode and a B phase hopping voltage applied to a B phase electrode of the toner bearing sleeve in FIG. 5.

FIG. 8 is a diagram showing waveforms of a periodic pulse voltage for A phase hopping, applied to an the A phase electrode 33*a*Y and a periodic pulse voltage for B phase hopping, applied to the B phase electrode 33*b*Y. The periodic pulse voltage for A phase hopping and the periodic pulse voltage for B phase hopping have opposite phases from each other as FIG. 8 shows, and the same average potentials per unit time. Lines horizontally extending from the center of the waveforms of the respective periodic pulse voltages for hopping are average potentials. Thus, the A phase electrode 33*a*Y and the B phase electrode 33*b*Y are averagely applied with a potential having a polarity reverse to that of a toner. The periodic pulse voltages for hopping are applied to the respective electrodes, a toner Y on the surface of the cylindrical part 31Y of the toner bearing sleeve 30Y reciprocates between the A phase electrode 33*a*Y and the B phase electrode 33*b*Y, hopping. Hereinafter, a state of a toner repeating hopping on the surface of the toner bearing sleeve 30Y at a predetermined cycle is referred to as "Flare".

Figure 9:
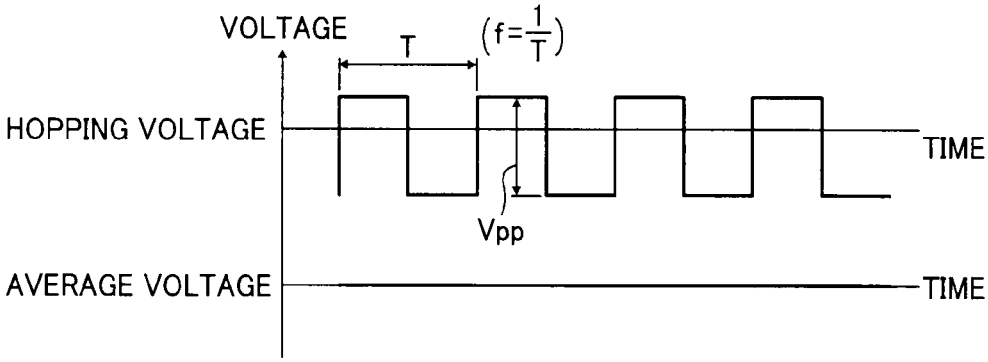
FIG. 9 is a diagram showing waveforms of an A phase hopping voltage applied to an A phase electrode and a B phase hopping voltage applied to a B phase electrode of another embodiment.

The periodic pulse voltage for A phase hopping and the periodic pulse voltage for B phase hopping include a periodic pulse voltage having a frequency of from 0.5 to 7 kHz and a peak-to-peak voltage of from ±60 to ±300 V overlapped with a DC voltage for controlling an average potential. A periodic pulse voltage having the shape of a square wave as shown in FIG. 8 can apply a large electrostatic force to a toner because its polarity can instantly be switched. Pulse voltages having the shape of a sine curve or a triangle wave may be used. Even when a periodic pulse voltage for hopping having the shape of a square wave and a frequency f is applied to one of the A phase electrode 33*a*Y and the B phase electrode 33*b*Y and a DC voltage which is an average potential of the pulse voltage is applied to the other, a flare can be made as the periodic pulse voltages for hopping having opposite phases each other are used as shown in FIG. 9.

The toner Y repeating hopping between the A phase electrode 33*a*Y and the B phase electrode 33*b*Y on the circumferential surface of the cylindrical part 31Y to form a flare thereon is transported by the rotary drive of the toner bearing sleeve 30Y to a recording area for Y facing the circuit board 10Y for Y shown in FIG. 4. Then, when the toner Y reaches near the circuit board 10Y at the peak of the parabolic hopping orbit in the recording area, it is fed into an unillustrated through-hole on the circuit board 10Y when needed, mentioned later, to be used to record a toner image.

As FIG. 6 shows, a surface protection layer 34Y formed of an insulative material is formed on the surface of the cylindrical part 31Y. The a surface protection layer 34Y prevents the toner Y from directly contacting the A phase electrode 33*a*Y and the B phase electrode 33*b*Y to inhibit a charge injection from the electrodes to the toner Y.

A substrate 32Y of the cylindrical part 31Y includes substrates formed of an insulative material such as a glass rate, a resin and a ceramic; substrates formed of an electroconductive material such as aluminum an insulative film such as $SiO_2$ is formed on; and substrates formed of a deformable material such as polyimide film, etc.

The A phase electrode 33*a*Y and the B phase electrode 33*b*Y are formed as follows. Namely, a film of an electroconductive material such as aluminum and Ni—Cr having a thickness of 0.1 to 10 μm is formed on the substrate 32Y, and which is formed to an electrode having a desired shape by photolithographic technologies. A film formed of an electroconductive material may be formed to an electrode by plating, etc.

The surface protection layer 34Y is formed of a film of $SiO_2$, $TiO_2$, TiN, $Ta_2O_5$, etc. having a thickness of from 0.5 to 10 μm. Organic materials such as polycarbonate, polyimide and methylmethacrylate may be coated by thin-film printing on a substrate to have a thickness of from 0.5 to 10 μm, and hardened upon application of heat.

Figure 10:
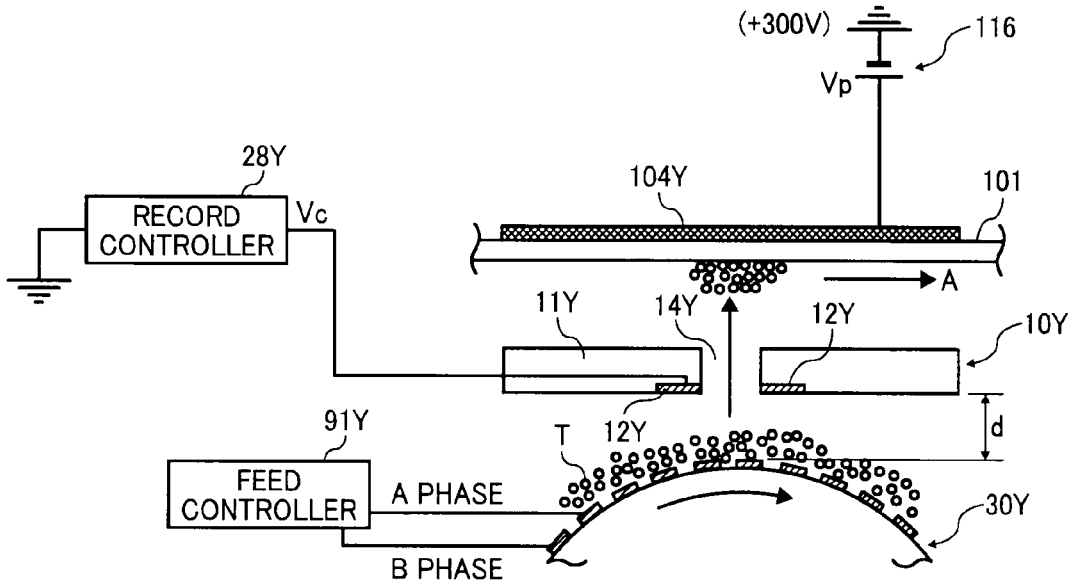
FIG. 10 is an amplified schematic view illustrating a part and a circumference of the image forming device in FIG. 5.

FIG. 10 is an amplified schematic view illustrating a part and a circumference of the image forming device 90Y for Y. The toner bearing sleeve 30Y as a toner bearer is rotationally driven clockwise while hopping a toner on the surface thereof between the A phase electrode and the B phase electrode to form a flare. The circuit board 10Y is located above the toner bearing sleeve 30Y with a gap d therefrom. Further, the intermediate recording belt 101 moves in an arrow direction A above the circuit board 10Y, and further above the circuit board 10Y, the facing electrode plate 104Y faces the toner bearing sleeve 30Y through the circuit board 10Y.

The circuit board 10Y includes an insulative substrate 11Y. In addition, the circuit board 10Y includes plural through-holes 14Y formed on the insulative substrate 11Y and plural fly control electrodes 12Y individually corresponding to the respective through-holes 14Y.

Figure 11:
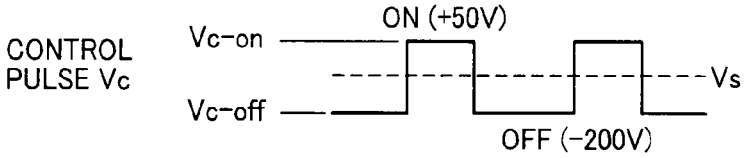
FIG. 11 is a diagram showing relationship between a record on voltage Vc-on and a record off voltage Vc-off applied to a fly control electrode of a circuit board of the image forming device in FIG. 5.

FIG. 11 is a diagram showing relationship between a record on voltage Vc-on and a record off voltage Vc-off applied to the fly control electrode 12Y as a hole-adjacent electrode.

Figure 12:
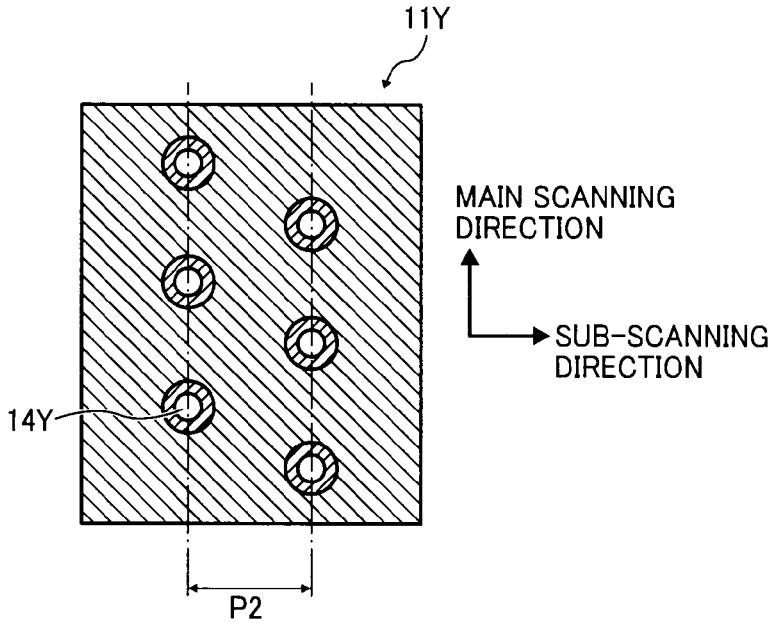
FIG. 12 is a plain view illustrating the circuit board of the image forming device in FIG. 5, seen from an electrode facing the circuit board.
Figure 13:
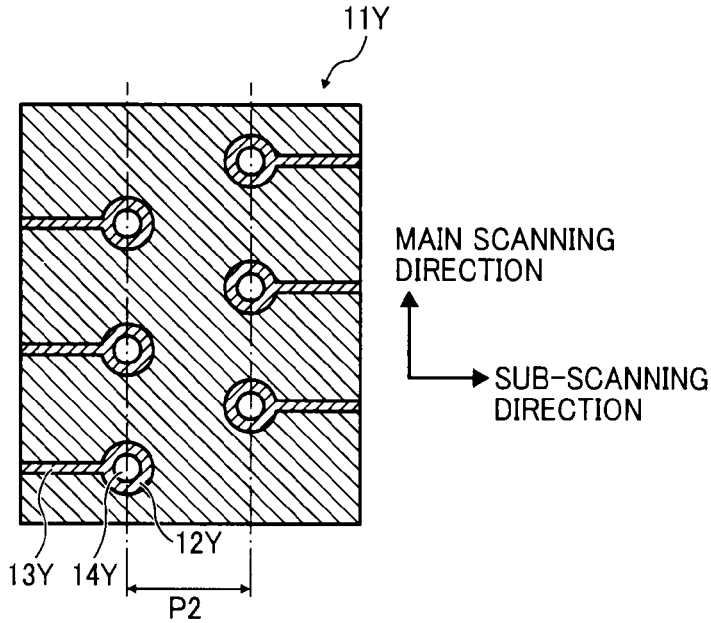
FIG. 13 is a plain view illustrating the circuit board of the image forming device in FIG. 5, seen from the toner bearing sleeve.

FIG. 12 is a plain view illustrating the circuit board 11Y seen from the electrode facing the circuit board. FIG. 13 is a plain view illustrating the circuit board 11Y seen from the toner bearing sleeve.

FIG. 10 just shows one combination of the through-hole 14Y and the fly control electrode 12Y as a matter of convenience, but plural combinations thereof are formed on the circuit board 10Y as FIGS. 12 and 13 show. The fly control electrode 12Y is formed such that one through-hole 14Y is located inside its ring-shaped loop. The plural fly control electrodes are respectively connected with metallic leads 13Y, and which are connected with a record controller 28Y in FIG. 10 mentioned later while keeping insulative to each other.

The ring-shaped fly control electrode 12Y has an electrode width of from 10 to 100 μm in a planar direction. The through-hole 14Y formed inside the ring-shaped fly control electrode 12Y has a diameter of from 50 to 200 μm, although depending on a diameter of a dot formed.

The circuit board 10Y is prepared, e.g., as follows. Namely, first, a metal-evaporated film such as aluminum-evaporated film having a thickness of from 0.2 to 1 μm is formed on an insulative substrate 11Y formed of an insulative film having a thickness of from 30 to 100 μm. The insulative film includes polyimide, PET, PEN, PES, etc. Next, a photoresist used in photolithographic technology is coated by spinner, prebaked and mask exposed. After the photoresist is hardened upon application of heat, a metal-evaporated film is formed to an electrode or a lead with a metal etching liquid. When an electrode pattern is needed on the backside of the film, the same method is used. The through-hole is formed by dry etching process such as punch process, laser process and sputtering process after the electrode is formed.

As FIG. 10 shows, the feed controller 91Y applies an A phase periodic pulse voltage for hopping and a B phase periodic pulse voltage to the A phase electrode and the B phase electrode of the toner bearing sleeve 30Y to hop a toner on the surface of the sleeve between the electrodes. Since every periodic pulse voltage has a duty ratio of 50%, an average potential of the peak-to-peak voltage Vpp is an average potential Vs on the surface of the sleeve. The periodic pulse voltage for hopping has a frequency f of from 0.5 to 7 KHz. The periodic pulse voltage for hopping preferably has a Vpp of from ±60 to ±300.

The fly control electrode 12Y of the circuit board 10Y is connected with the record controller 28Y. The record controller 28Y individually applies a record on voltage Vc-on and a record off voltage Vc-off to the fly control electrode 12Y of the circuit board 10Y as FIG. 11 shows. A dot line between the record on voltage Vc-on and the record off voltage Vc-off is an average potential Vs of the A phase hopping voltage and rge B phase hopping voltage in FIG. 11. Namely, the average potential Vs of the hopping voltage is between the record on voltage Vc-on and the record off voltage Vc-off applied to the fly control electrode 12Y. More specifically, the record on voltage Vc-on is larger than the average potential Vs of the sleeve in a polarity opposite to that of a charged toner. Among the plural fly control electrodes 12Y, those applied with the record on voltage Vc-on attract a toner hopping on the surface of the sleeve located above. The record off voltage Vc-off is larger than the average potential Vs of the sleeve in a polarity to that of a charged toner. Among the plural fly control electrodes 12Y, those applied with the record on voltage Vc-off repel a toner hopping on the surface of the sleeve located above.

The facing electrode plates 104Y facing the toner bearing sleeve 30Y through the circuit board 10Y and the intermediate recording belt is applied with a facing bias Vp by a facing electric source 116. The facing bias has a polarity opposite to that of a charged toner and is larger than the record on voltage Vc-on in a polarity opposite to that of a charged toner.

Figure 14:
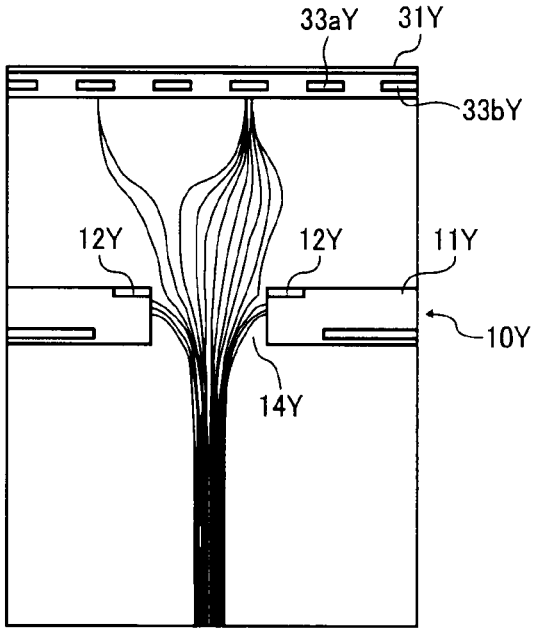
FIG. 14 is an amplified schematic view illustrating the fly control electrode applied with a record on voltage Vc-on and a circumference thereof of the image forming device in FIG. 5.
Figure 15:
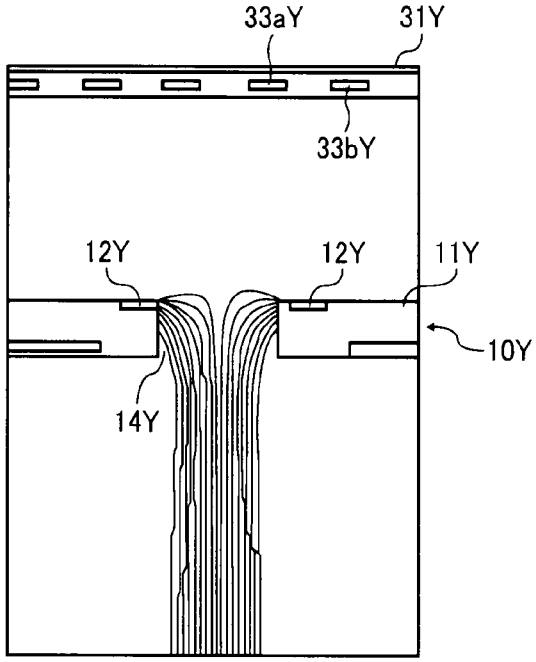
FIG. 15 is an amplified schematic view illustrating the fly control electrode applied with a record off voltage Vc-off and a circumference thereof of the image forming device in FIG. 5.

FIG. 14 is an amplified schematic view illustrating the fly control electrode 12Y applied with a record on voltage Vc-on and a circumference thereof. FIG. 15 is an amplified schematic view illustrating the fly control electrode 12Y applied with a record off voltage Vc-off and a circumference thereof. Lines of electric force in FIGS. 14 and 15 are determined by a simulation program analyzing the line of electric force around the electrode with a predetermined algorism.

A periodic pulse voltage for hopping is applied to the A phase electrode 33*a*Y and the B phase electrode 33*b*Y of the toner bearing sleeve. The periodic pulse voltage has a crest value according to the electrode pitch, a toner used, etc. According to an ordinary experimental result, Vpp of from ±60 to ±300 can fly a toner. Vpp of ±200 and DC voltage 0 V are applied in Figs. The toner bearing sleeve and the circuit board 10Y have a gap d of 0.2 mm therebetween.

The through-hole on the circuit board 10Y has a diameter of 120 μm and the ring-shaped fly control electrodes 12Y has a width of 50 μm in a center of the hole direction. The record on voltage Vc-on enabling a toner T to pass the through-hole 14Y, applied to the fly control electrodes 12Y, is +50 V. The record off voltage Vc-off disabling a toner T to pass the through-hole 14Y, in other words, inhibiting a toner T from passing the through-hole 14Y is −200 V.

The facing bias Vp applied to an unillustrated facing electrode is a DC voltage of from +200 to +1,500 V, although depending on a gap between the circuit board 10Y and the intermediate recording belt 101. The gap is 0.3 mm and a facing bias Vp of DC +600 V is applied to the facing electrode to form a potential gradient attracting a negatively-charged toner T to the intermediate recording belt 101.

When the periodic pulse voltage for hopping is applied to the A phase electrode 33*a*Y and the B phase electrode 33*b*Y, among the lines of electric force coming from the unillustrated facing electrode, many of the lines of electric force passing the through-hole 14Y reach the A phase electrode 33*a*Y and the B phase electrode 33*b*Y applied with a voltage of −200 V of the toner bearing sleeve after passing the through-hole 14Y in FIG. 14. Therefore, a toner hopping on the sleeve passes the through-hole 14Y and reaches the surface of the belt on the facing electrode plate.

In FIG. 15, a line of electric force extended from an unillustrated facing electrode remains at a position of the fly control electrodes 12Y after entering the through-hole 14Y. Then, the toner T hopping on the surface of the toner bearing sleeve does not enter the through-hole 14Y.

Figure 16:
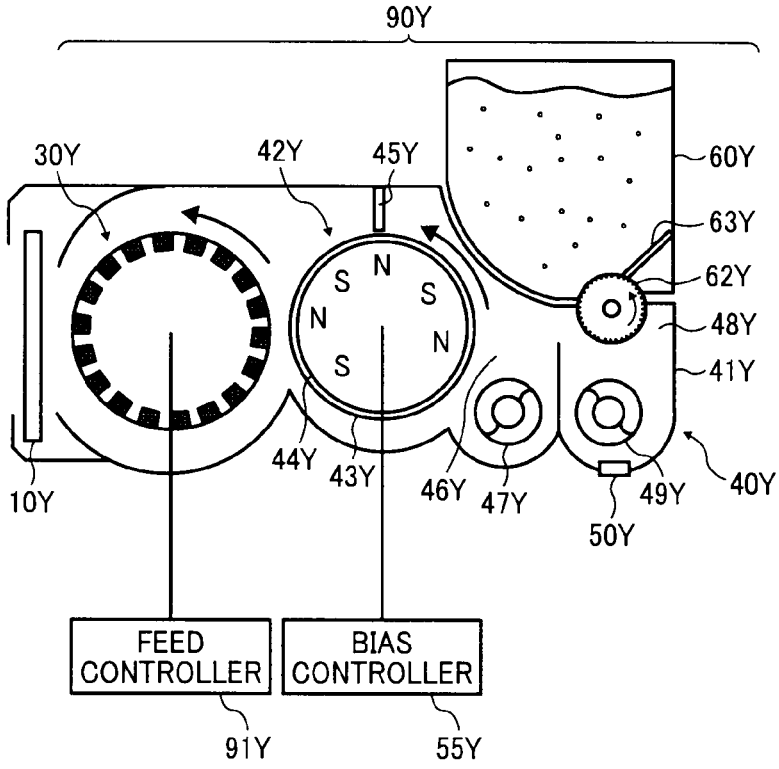
FIG. 16 is an amplified schematic view illustrating a configuration of the image forming device in FIG. 5.

FIG. 16 is an amplified schematic view illustrating a configuration of the image forming device 90Y. FIG. 4 omits a circumferential configuration f the toner bearing sleeve 30Y, but which is contained in a casing 41Y of a hopping unit 40Y. The hopping unit 40Y includes a first developer container 48Y, a second developer container 46Y, a magnetic brush, etc. besides the toner bearing sleeve 30Y.

The first developer container 48Y includes a first feed screw 49Y rotationally driven clockwise with a mixed developer including a magnetic carrier and a toner. The second developer container 46Y includes a second feed screw 47Y rotationally driven anticlockwise with a mixed developer. The developer containers are partitioned by a partition with each other and partly communicated with each other through a communication opening. The first feed screw 49Y is rotationally driven to feed the mixed developer in the first container 48Y from the front side to the backside in a direction perpendicular to a paper surface while rotationally stirring the mixed developer. Then, a toner concentration sensor 50Y fixed on the ceiling of the first container 48Y detects a toner concentration of the mixed developer being fed. The mixed developer fed near the end of the backside enters the second developer container 46Y through the communication opening of the partition wall.

The second container 46Y is communicated with a magnetic brush including a toner feed roll 42Y mentioned later, and the second feed screw 47Y and the toner feed roll 42Y faces each other through a predetermined gap parallely in their axial directions. The second feed screw 47Y is rotationally driven to feed the mixed developer in the second container 46Y from the front side to the backside while rotationally stirring the mixed developer. In this process, apart of the mixed developer fed by the second screw 47Y is scooped by a cylindrical toner feed sleeve 43Y of the toner feed roll 42Y. The part of the mixed developer passes a toner feed area mentioned later with an anticlockwise rotation of the toner feed sleeve 43Y and leaves from the surface thereof, and returns into second container 46Y again. The mixed developer fed by the second feed screw 47Y near the end of the front side passes the communication opening of the partition wall and returns into the first container 48Y.

The toner concentration sensor 50Y is a permeability sensor. The detection result of the mixed developer thereby is transmitted to an unillustrated controller as a voltage signal. The permeability of the mixed developer has a correlation with a concentration of the K toner thereof, and the toner concentration sensor 50Y produces a voltage depending on the toner concentration.

The unillustrated controller of the printer includes a RAM (Random Access Memory) as a data memory storing a target of production voltage Vtref for Y from the toner concentration sensor 50Y. Comparing the production voltage from the toner concentration sensor 50Y with Vtref for Y in RAM, the controller rotates a toner feed member 62Y of a toner feeder 60Y for a time based on the comparison result.

The toner feeder 60Y is mounted above the hopping unit 40Y, placing the toner feed member 62Y right above the first container 48Y of the hopping unit 40Y. The roller-shaped toner feed member 62Y is rotatably located at the bottom of the toner feeder 60Y, and rotates while buried in a toner in the toner feeder 60Y. The toner feed member 62Y discharges toners included in plural microscopic concavities formed on the surface thereof into the first container 48Y. Prior to this discharge, extra toners adhering to the surface of the toner feed member 62Y are removed by a scrape blade 63Y. Thus, a suitable amount of a toner is fed into the first container 48Y for the mixed developer having lower concentration of the toner due to consumption thereof for image formation. Therefore, the toner concentration of the mixed developer in the second container 46Y is maintained within a predetermined range.

The toner feed roll 42Y includes the cylindrical toner feed sleeve 43Y formed of a non-magnetic material rotationally driven anticlockwise and a magnet roller 44Y which does not rotate in conjunction with the toner feed sleeve 43Y. The cylindrical toner feed sleeve 43Y is a cylindrical non-magnetic material such as aluminum, brass, stainless and electroconductive resins. The magnet roller 44Y includes plural magnetic poles in a rotational direction (from 12 o'clock position, a N-pole, a S-pole, a N-pole, a S-pole, a N-pole and a S-pole are lined in this order anticlockwise). The mixed developer is adsorbed by the magnetic poles to the circumferential surface of the toner feed sleeve 43Y and becomes an earing magnetic brush along a magnetic line.

The mixed developer scooped on the surface of the toner feed sleeve 43Y rotates anticlockwise with rotation of the toner feed sleeve 43Y. The mixed developer enters a bearing amount regulation position a regulation member 45Y faces facing its end against the surface of the toner feed sleeve 43Y through a predetermined gap. When the mixed developer passes the gap between the regulation member 45Y and the surface of the sleeve, the bearing amount of the developer on the surface thereof is regulated.

At the left side of the toner feed sleeve 43Y, the toner bearing sleeve 30Y bearing a toner is rotationally driven by an unillustrated driver anticlockwise while facing the surface of the toner feed sleeve 43Y through a predetermined gap. The mixed developer having passed the bearing amount regulation position with rotation of the toner feed sleeve 43Y enters the toner feed area contacting the toner bearing sleeve 30Y and transfers scraping the end of the magnetic brush. The scrape and a difference of potential between the toner feed sleeve 43Y and the toner bearing sleeve 30Y provide a toner in the magnetic brush onto the surface of the toner bearing sleeve 30Y. A bias controller 55Y applies a variable bias to the toner feed sleeve 43Y. When the toner feed sleeve 43Y feeds a toner to the toner bearing sleeve 30Y, the bias controller 55Y applies a toner feed bias to the toner feed sleeve 43Y. Then, an electric field transporting a toner from the toner feed sleeve 43Y to the toner bearing sleeve 30Y is formed. The feed bias may be a DC voltage having the same polarity as a toner does, and the DC bias may be overlapped with an AC voltage.

The magnetic brush (mixed developer) on the toner feed sleeve 43Y having passed the toner feed area is transferred to a position facing the second developer container 46Y with rotation of the sleeve. Near the position, the magneto roller 44Y does not have a magnetic pole having a magnetic force attracting the mixed developer to the surface of the sleeve, and the mixed developer leaves therefrom and returns into the second developer container 46Y. The magnet roller 44Y may have more than 6 magnetic poles. The toner bearing sleeve 30Y bearing a toner fed from the toner feed sleeve 43Y exposes a part of its circumferential surface from an opening of the casing 41Y. The exposed part faces the circuit board 10Y.

A toner fed on the surface of the toner bearing sleeve 30Y is transferred to an area facing the circuit board 10Y with rotation of the toner bearing sleeve 30Y while hopping on the surface thereof. In the area facing the circuit board 10Y, the toner is drawn into the through-hole of the circuit board 10Y as necessary to be used for recording a dot. The image forming device 90Y for Y has been explained in detail. The other image forming devices 90M, 90C and 90K have the same configurations.

Unlike the image forming apparatus drawing a toner adhering to the surface of a toner bearer into a through-hole of a circuit board, which is disclosed in Japanese published unexamined application No. 63-136058, the above-mentioned printer draws a toner hopping on the surface of the toner bearer into the through-hole of the circuit board. This can reduce cost of the record controller such as 28Y controlling a voltage applied to the fly control electrode of the circuit board. Specifically, turning on and off of the record on voltage Vc-on and the record of voltage V-off relative to the plural fly control electrodes need to be individually made by an exclusive IC. Considerable numbers of the ICs are needed, e.g., 2,482 pieces of the ICs are needed to form an image having an image resolution of 300 dpi. Typically, IC becomes expensive because the higher the voltage resistance, the larger the chip area. In the direct recoding method, it is essential that the control voltage is decreased to reduce cost of the record controller. However, the image forming apparatus disclosed in Japanese published unexamined application No. 63-136058 needs using an IC having a voltage resistance at least not less than 500 V. This is because there is an adherence attracting a toner and the toner bearing sleeve to each other such as an image force, van der Waals force and a cross-linking force, and a bias having at least an absolute value not less than 500 V needs to be applied to the fly control electrode to form a magnetic field stronger than these forces. In the printer of the present invention, a toner is hopping on the surface of the toner bearing sleeve 30Y to get rid of the adherence between the surface of the sleeve and the toner, and just a bias of tens of volts is applied to the fly control electrode to control the record on and off. Namely, the IC having a voltage resistance about 200 V can be used.

Next, specific configurations of the printer of the present invention will be explained.

Figure 17:
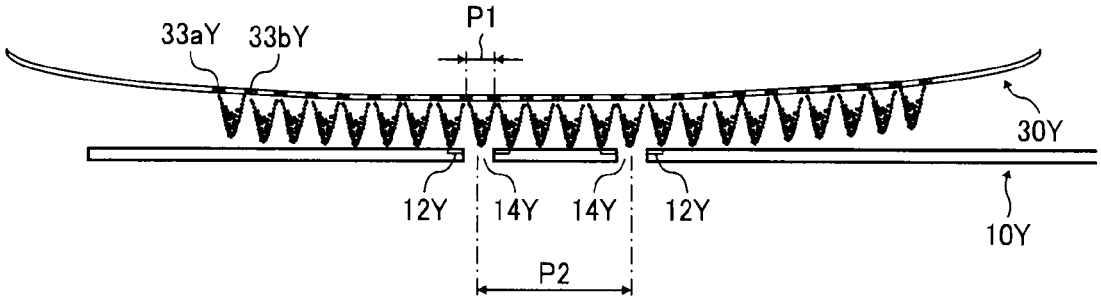
FIG. 17 is an amplified schematic view illustrating the toner bearing sleeve and the circuit board of the image forming device in FIG. 5.

FIG. 17 is an amplified schematic view illustrating the toner bearing sleeve 30Y and the circuit board 10Y in the image forming device for Y of the first embodiment of the printer of the present invention. In FIG. 17, the toner bearing sleeve 30Y is rotationally driven by an unillustrated driver. On the surface thereof, a toner reciprocates between the A phase electrode 33*a*Y and the B phase electrode 33*b*Y hopping along a parabolic orbit. A hopping pitch of a toner in a line direction of columns of the A phase electrode 33*a*Y and the B phase electrode 33*b*Y which are hopping electrodes is equal to an arrangement pitch P1 alternately arranging the A phase electrode 33*a*Y and the B phase electrode 33*b*Y. In the first embodiment of the printer, an arrangement pitch P2 of the through-hole 14Y in the line direction of columns is five times as long as the hopping pitch of a toner (=P1). Thus, in the line direction of columns, a positional relation of the through-hole 14Y and a parabolic orbit of a toner hopping closest thereto is same at each through-hole 14Y. The center of the through-hole 14Y in the first line and that of the parabolic orbit of the toner hopping thereon are synchronized, and the center of the through-hole 14Y in the second line and that of the parabolic orbit of the toner hopping thereon are synchronized. When positional relations between the through-holes 14Y and the parabolic orbits of toners are same in the line direction of columns, an amount of toner entering the through-hole 14Y can be equalized regardless of the position of the through-hole 14Y. Therefore, uneven image density due to differences of amount of toner entering the through-holes 14Y, caused by positional differences thereof, can be avoided.

In this embodiment, the arrangement pitch P2 of the through-hole 14Y in the line direction of columns is five times as long as the hopping pitch (=P1), and integral multiples other than five times can have the same effect. When the A phase electrode 33*a*Y and the B phase electrode 33*b*Y are alternately arranged, the hopping pitch is almost equal to the alternate arrangement pitch of the A phase electrode 33*a*Y and the B phase electrode 33*b*Y. As the second embodiment mentioned later, when plural reed-shaped A phase electrodes or B phase electrodes are arranged at a predetermined pitch in a sub-scanning direction and one large B phase electrode or A phase electrode is arranged underlying, the hopping pitch is about half of the arrangement pitch of the reed-shaped electrodes.

Figure 18:
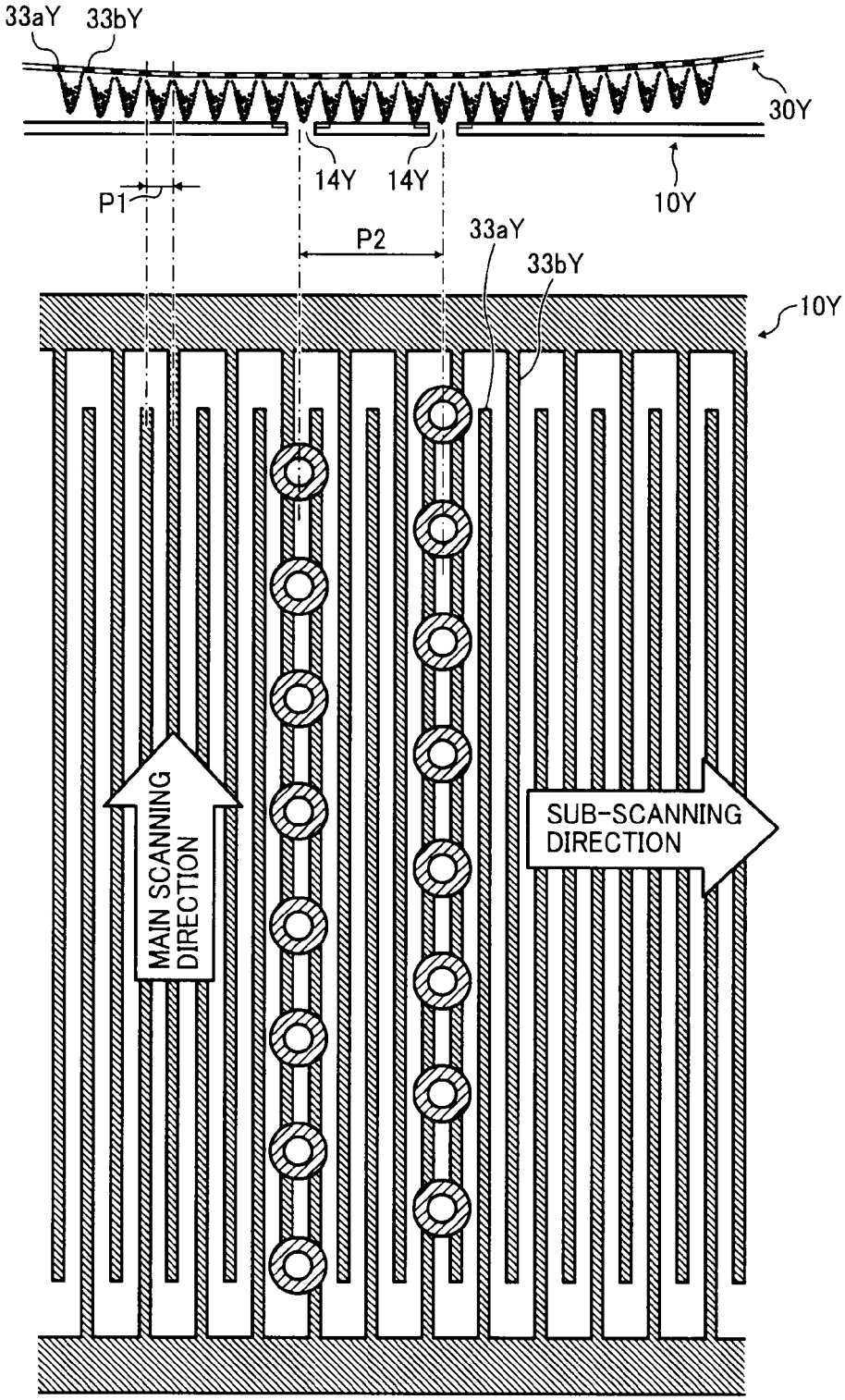
FIG. 18 is a schematic view for explaining positional relationships between a through-hole and the A or B phase electrode of the toner bearing sleeve of the image forming device in FIG. 5.

FIG. 18 is a schematic view for explaining positional relationships between the through-hole 14Y and the A phase electrode 33*a*Y or the B phase electrode 33*b*Y of the toner bearing sleeve 30Y. The middle of the A phase electrode 33*a*Y and the B phase electrode 33*b*Y of the toner bearing sleeve 30Y is located at the same position of the center of the through-hole 14Y of the circuit board 10Y. When a toner hopping on the surface of the sleeve has a tidemark on its parabolic orbit at the same position of the center of the through-hole 14Y, the hopping toner is present near the through-hole 14Y. When a record on voltage Vc-on is applied to the fly control electrode 12Y, amounts of toner entering the individual through-holes 14Y can be almost the same. Therefore, in the sub-scanning direction which is a line direction of columns of the hopping electrode, the record on voltage Vc-on is preferably applied such that a peak of a parabola a toner is hopping along on the surface of the toner bearing sleeve 30Y faces the through-hole 14Y. However, the toner bearing sleeve 30Y is rotationally driven and such a timing is a split second. The record on voltage Vc-on needs to be applied in the split second.

The printer has the following configuration. Namely, it has a relative position detector grasping a relative position of the A phase electrode 33*a*Y and the B phase electrode 33*b*Y moving on the surface of the toner bearing sleeve 30Y with rotation to the through-hole 14Y of the circuit board 10Y. The relative position detector includes a rotary encoder detecting a rotational angle of the toner bearing sleeve 30Y. The rotary encoder grasps the rotational angle of the toner bearing sleeve 30Y to grasp a timing for positioning the middle of the A phase electrode 33*a*Y and the B phase electrode 33*b*Y with the center of the through-hole 14Y. A means of grasping step pulse number of a stepping motor for rotating the toner bearing sleeve 30Y may replace the rotary encoder as the relative position detector. Grasping the step pulse number can grasp the rotational angle of the toner bearing sleeve and the timing mentioned above.

Figure 19:
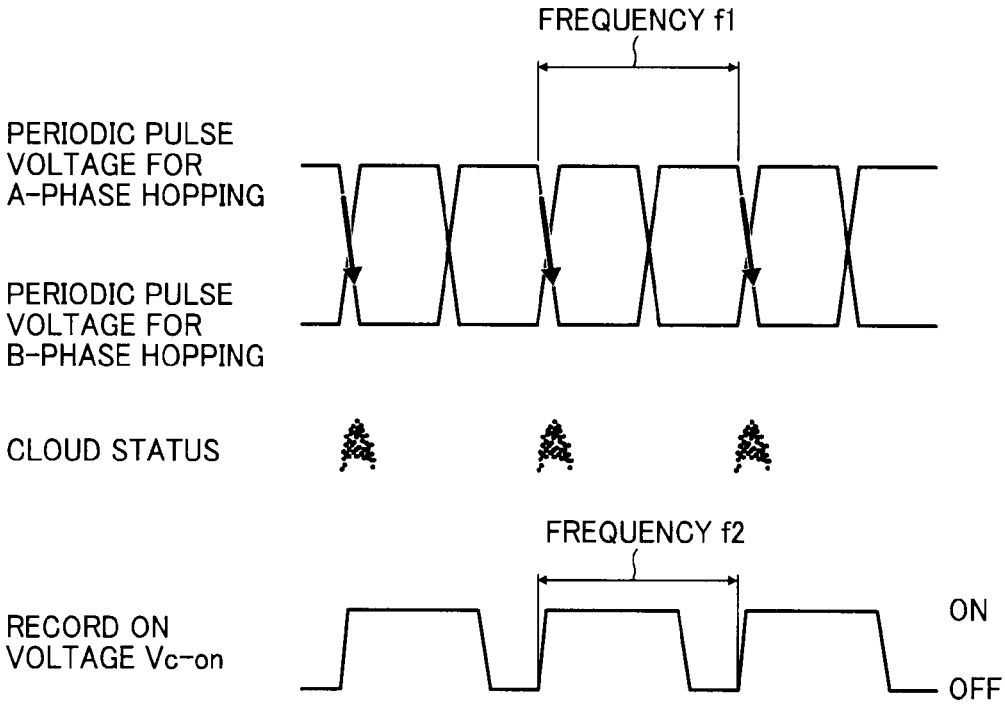
FIG. 19 is a diagram showing each voltage and hopping status of a toner in the image forming device in FIG. 5.

FIG. 19 is a diagram showing each voltage and hopping status of a toner. On the toner bearing sleeve, when the A phase periodic pulse voltage for hopping has a peak above the diagram (maximum peak of a polarity opposite to that of a charged toner), the B phase periodic pulse voltage for hopping has a peak below the diagram (maximum peak of a polarity same as that of a charged toner). Then, most of the toner are landing on the A phase electrode. When the A phase periodic pulse voltage for hopping is turned off and the B phase electrode is turned on, the toner landing on the A phase electrode flies on the parabolic orbit. When the A phase periodic pulse voltage for hopping has a peak below the diagram, the B phase periodic pulse voltage for hopping has a peak above the diagram. Then, most of the toner particles are landing on the B phase electrode. When the B phase periodic pulse voltage for hopping is turned off and the A phase electrode is turned on, the toner landing on the B phase electrode flies on the parabolic orbit. Therefore, a timing for turning on and off the periodic pulse voltage for hopping is a timing locating a toner at the tidemark of the parabola.

The printer includes a phase regulator regulating phases of the A phase periodic pulse voltage for hopping and the B phase periodic pulse voltage for hopping based on the detection result of the relative position detector in the feed controller 91Y producing the A phase periodic pulse voltage for hopping and the B phase periodic pulse voltage for hopping. The phase regulator regulates the respective periodic pulse voltages for hopping such that the timing of turning on and off of the hopping periodic pulse voltage and the timing of positioning the middle of the A phase electrode 33*a*Y and the B phase electrode 33*b*Y with the center of the through-hole 14Y are synchronized. Thus, as shown in FIG. 17, a timing for most of the hopping toner to reach the tidemark of the parabola and a timing of positioning the peak thereof with the center of the through-hole 14Y are synchronized.

The record controller applying a record on voltage Vc-on and a record off voltage Vc-off to the fly control electrode has the following configuration. Namely, the record controller synchronizes a timing of starting applying the record on voltage Vc-on with the timing of turning on or off of the A phase periodic pulse voltage for hopping. Thus, as shown in FIG. 17, when most of the hopping toner reach the tidemark of the parabola and are present near the through-holes 14Y, the record on voltage Vc-on is applied so that a large amount of the toner can enter the through-holes 14Y.

Only the image forming devices for Y has been explained, and the image forming devices for the other colors have the same configurations and equalize an amount of the toner passing the through-holes 14 to prevent uneven image density.

Figure 20:
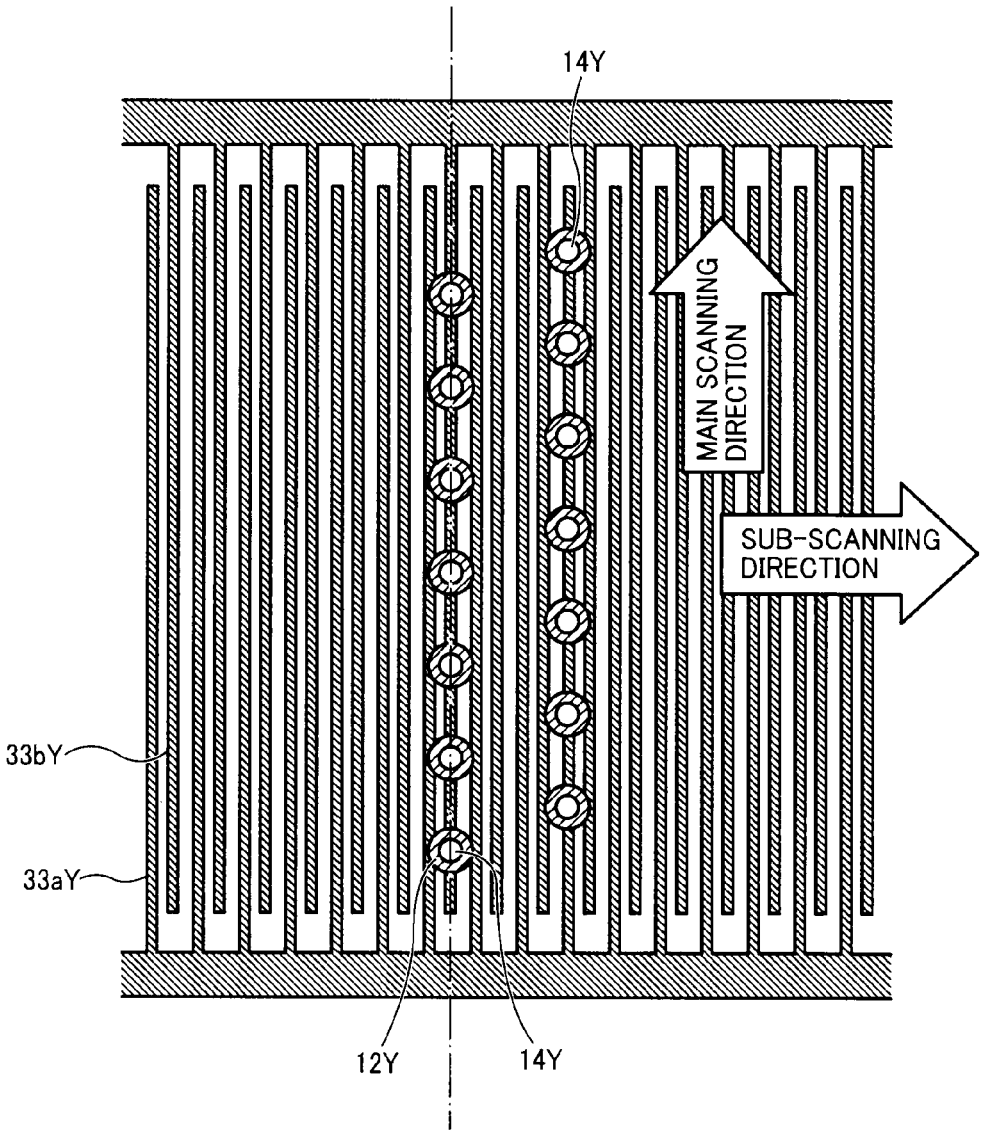
FIG. 20 is a schematic view for explaining positional relationships between a through-hole and the A or B phase electrode when the circuit board is installed without a tilt in the image forming device in FIG. 5.
Figure 21:
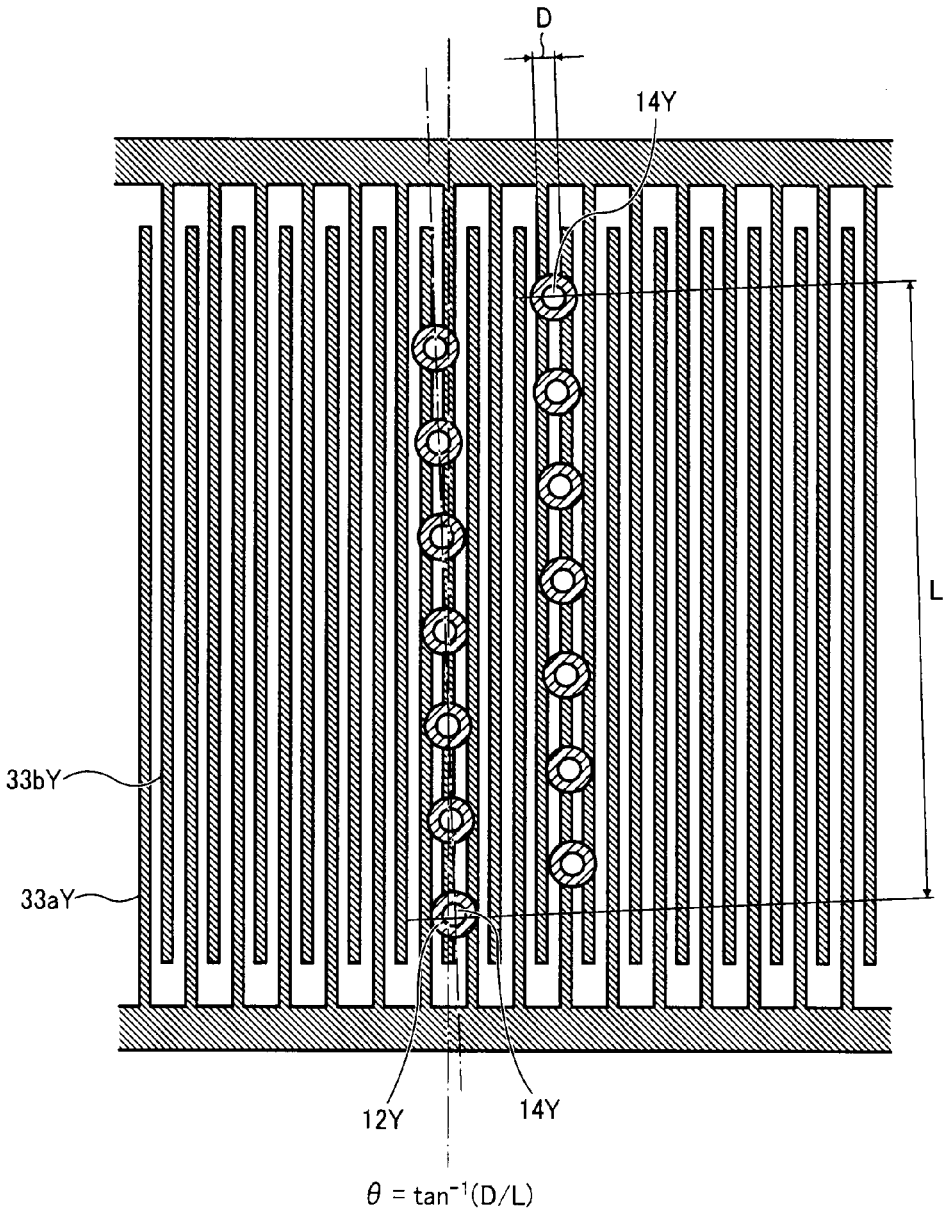
FIG. 21 is a schematic view for explaining positional relationships between a through-hole and the A or B phase electrode when the circuit board is installed with a slight tilt in the image forming device in FIG. 5.

On the circuit board 10Y, as shown in FIG. 20, lines of the through-holes 14T and the ring-shaped fly control electrodes are preferably mounted without gradient straight along an extending direction of the A phase electrode 33*a*Y and the B phase electrode 33*b*Y of the toner bearing sleeve. An end and the other end of the line causes an error of the positional relation between the through-hole 14Y and the parabolic orbit of the toner with the gradient. As shown in FIG. 21, an angle θ preferably satisfies the following relationship:

$$\theta < \tan^{-1}(D/L)$$

wherein L represents a distance between the through-hole 14Y at the farthest point and the through-hole at the opposite farthest point in a line direction of columns; and D represents a diameter of the through-hole 14Y. The angle θ is an angle between an extending direction of columns of the fly control electrode 12Y and that of the A phase electrode 33*a*Y or the B phase electrode 33*b*Y. Namely, a shift length between the through-hole 14Y at the farthest point and the through-hole at the opposite farthest point in a line direction of columns is less than the diameter D.

The reason why the angle θ preferably satisfies the relationship will be explained in detail. Uneven image density in a line direction of columns of the fly control electrode 12Y (recording paper feeding direction=sub-scanning direction) has been explained. Besides the uneven image density, uneven image density may occur in an extending direction of columns of the fly control electrode 12Y (=main scanning direction). One of the reasons of the uneven image density includes comparatively a large angle θ. The larger the angle θ, the larger the uneven image density in the line direction of columns of the fly control electrode 12Y. When the angle θ is $\tan^{-1}$ (D/L), the uneven image density is maximum. Namely, the toner hopping on the toner bearing sleeve hops along the parabolic hopping orbit. The hopping orbit moves with the rotation of the toner bearing sleeve on the rotational orbit thereof. It is easiest for the toner to enter the through-hole 14Y when the peak of the parabolic hopping orbit just reaches a position facing the through-hole 14Y. Then, the toner enters the through-hole 14Y most to heighten the density of a dot most. When the bottom of the parabolic hopping orbit reaches the position facing the through-hole 14Y, the toner enters the through-hole 14Y least to lighten the density of a dot most. When the shift length between the through-hole 14Y at the farthest point and the through-hole at the opposite farthest point in a line direction of columns is equal to the diameter D, the bottom of the hopping orbit faces the latter through-hole 14Y when the peak of the hopping orbit faces the former through-hole 14Y. Therefore, a dot located at an end of a line extending direction in a line image has a maximum image density and a dot located at the other end has a minimum image density, and the uneven image density in the line (column) extending direction is highly visible.

The present inventors performed the following experiments. Voltages having a frequency of 0.6 kHz were used for the A phase periodic pulse voltage for hopping and the B phase periodic pulse voltage for hopping. A frequency of 0.59 kHz was used for the periodic application timing of the record on voltage Vc-on (hereinafter referred to as a "record on frequency"). A recording paper was fed at 50 mm/s. A solid image was produced, and while a recording paper was transferred for 50 mm, an image density pattern repeating low and high image density in the sub-scanning direction of the solid image appeared for 10 times, which could easily be visible to the naked eye. A difference of 10 Hz between the frequency of the periodic pulse voltages for hopping and that of the record on frequency caused the 10-time image density pattern for 1 sec during which the recording paper was transferred for 50 mm. When the difference is large, so many thick and thin image density patterns appear per unit length that the uneven image density is not so noticeable. When small, the uneven image density is noticeable.

When $\theta < \tan^{-1}$ (D/L) is satisfied, $\theta = \tan^{-1}$ (D/L) maximizing a difference of image density between a dot at an end of the line extending direction and a dot at the other end due to the angle θ is avoided to make the difference unnoticeable.

Next, other embodiments of the printer of the present invention will be explained. The configurations of the printers are the same as that of the first embodiment unless otherwise specified.

Second Embodiment

In order to prevent the uneven image density, arrangement pitch of the A phase electrode or the B phase electrode needs to be microscopic, e.g., tens of microns. However, a hopping voltage having a large amplitude is applied to the A phase electrode or the B phase electrode arranged at a microscopic pith for a toner to hop well, a current is likely to leak between the electrodes. The leak specifically occurs as follows. As shown in FIG. 6, an insulative material lies between the A phase electrode 33*a*Y and the B phase electrode 33*b*Y. This prevents a discharge therebetween. However, the A phase electrode 33*a*Y, the B phase electrode 33*b*Y and the insulative material are all formed on the same surface of the insulative substrate 32Y. An interface between the A phase electrode 33*a*Y and the substrate 32Y, an interface between the insulative material and the substrate 32Y, and an interface between the B phase electrode 33*b*Y and the substrate 32Y are continuously linked together. When a hopping voltage having a large amplitude is applied to at least one of the A phase electrode and the B phase electrode, a discharge between the electrodes in the continuous interface occurs, resulting in leak of current.

Figure 22:
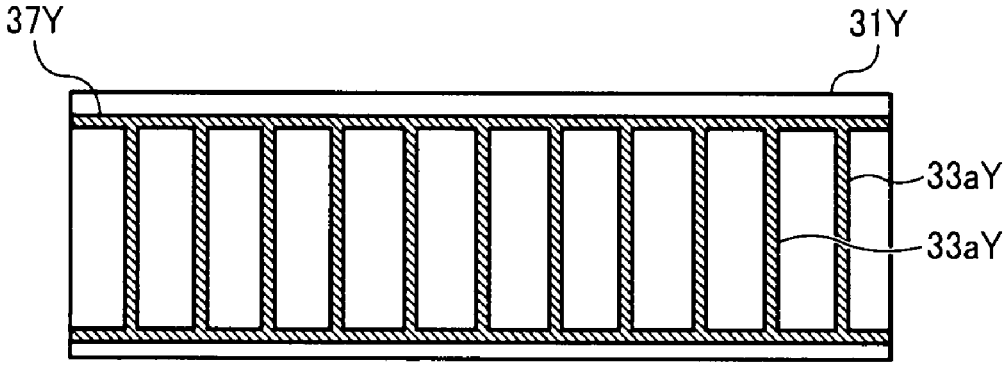
FIG. 22 is a plain development view illustrating a cylindrical part of a yellow toner bearing sleeve of a second embodiment of the image forming apparatus of the present invention.
Figure 23:
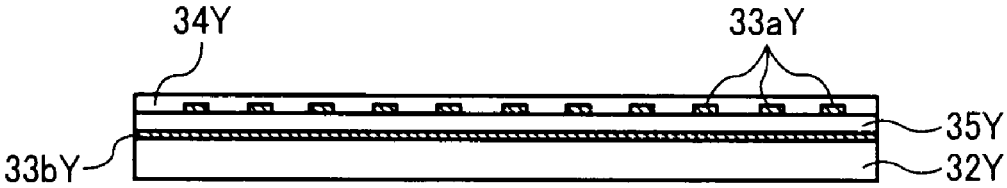
FIG. 23 is a cross-sectional view illustrating the toner bearing sleeve in FIG. 22.

FIG. 22 is a plain development view illustrating a cylindrical part 31Y of a yellow toner bearing sleeve of the second embodiment of the printer of the present invention. FIG. 23 is a cross-sectional view illustrating the cylindrical part 31Y. The second embodiment of the printer includes a multilayered toner bearing sleeve in which an A phase electrode 33*a*Y and a B phase electrode 33*b*Y are formed on different layers through an insulative layer 35Y therebetween. All the surface of a cylindrical substrate 32Y is coated with a metallic layer, and the metallic layer works as the B phase electrode 33*b*Y. The insulative layer 35Y formed of a resin is layered on the surface of the B phase electrode 33*b*Y. Further, plural A phase electrodes 33*a*Y lined at a predetermined pitch in a circumferential direction are formed on the surface of the insulative layer 35Y. The B phase electrode 33*b*Y is a large cylindrical electrode, and a first electrode is present between each of the plural A phase electrodes 33*a*Y lined at a predetermined pitch in the circumferential direction of the toner bearing sleeve. On the surface of the cylindrical part 31Y, a toner can hop between the plural A phase electrodes 33*a*Y and places of the B phase electrode 33*b*Y equivalent to those of the A phase electrodes. The large cylindrical B phase electrode 33*b*Y and the plural A phase electrodes 33*a*Y are formed on separate layers through the insulative layer 35Y therebetween, and the A phase electrode 33*a*Y and the B phase electrode 33*b*Y are not linked through a continuous interface. A discharge is prevented between the A phase electrode 33*a*Y and the B phase electrode 33*b*Y to enable it to apply a hopping voltage having a large amplitude.

Figure 24:
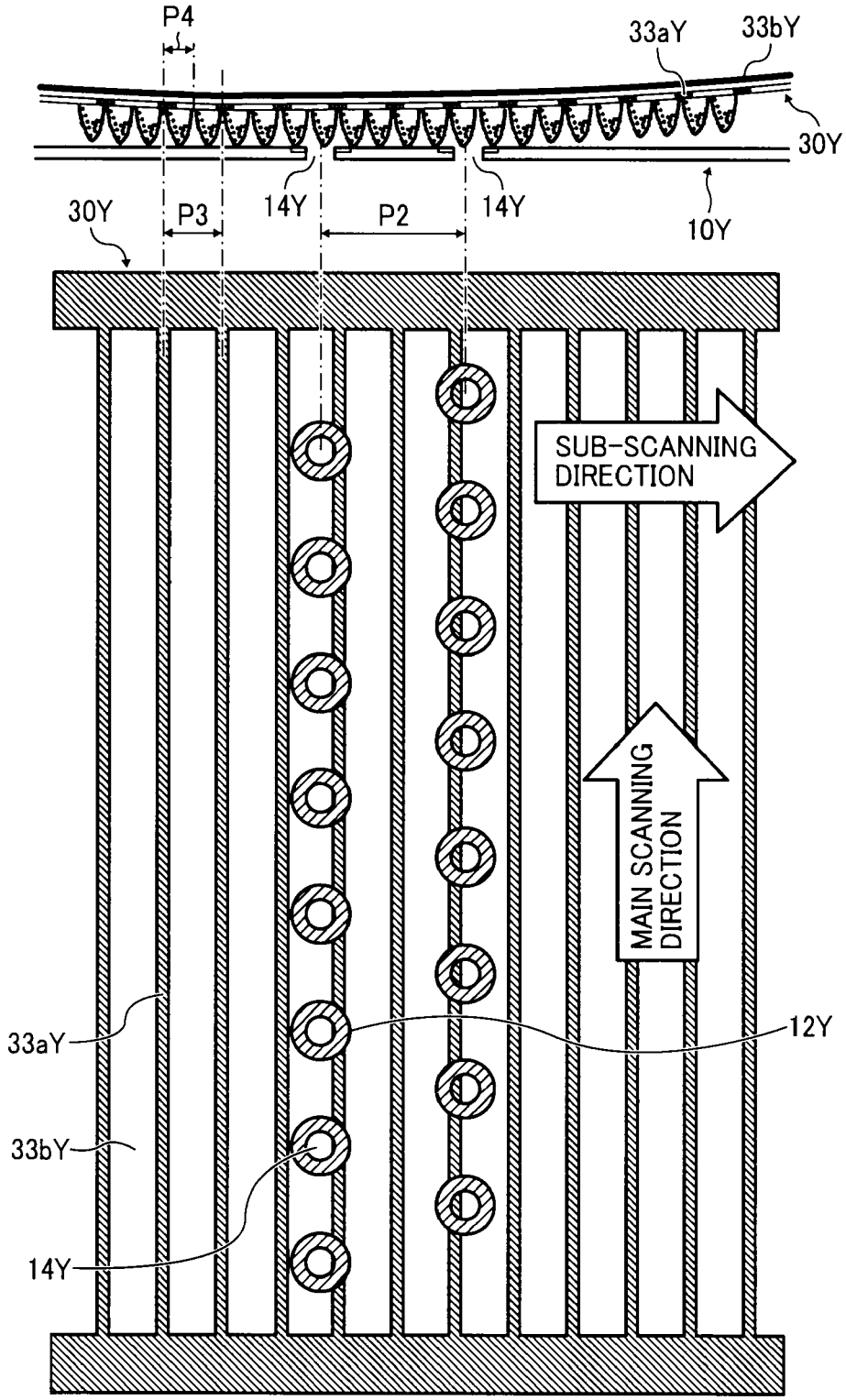
FIG. 24 is a schematic view for explaining positional relationships between a through-hole and an A phase electrode of the toner bearing sleeve of the image forming device in FIG. 22.

FIG. 24 is a schematic view for explaining positional relationships between the through-hole 14Y and the A phase electrode 33*a*Y of the toner bearing sleeve of the second embodiment of the printer. The plural A phase electrodes 33*a*Y are line at an arrangement pitch P3. A hopping pitch P4 of a toner in a line direction of the electrode is half of the arrangement pitch P3. An arrangement pitch P2 of the through-holes 14Y is 5 times as long as of the hopping pitch P4, and the uneven image density can be avoided as the first embodiment.

Figure 25:
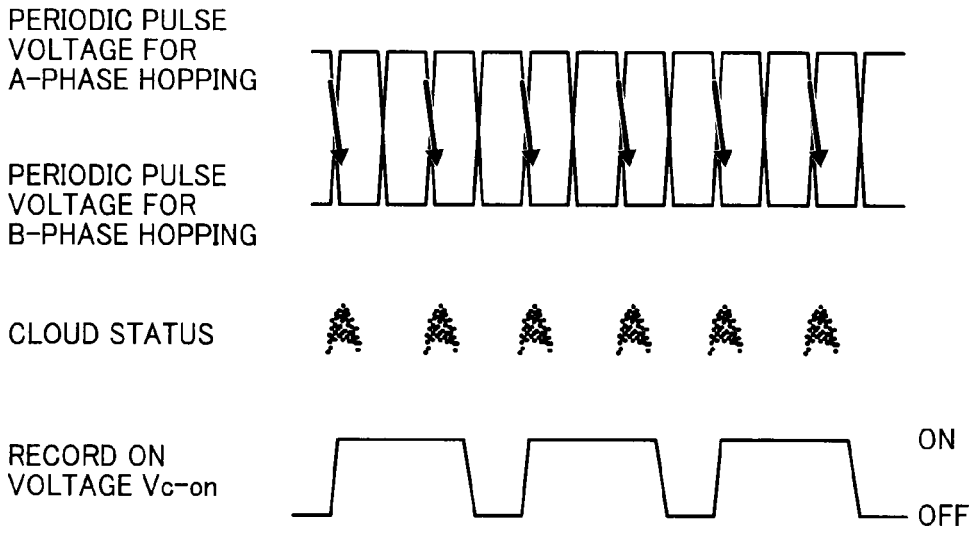
FIG. 25 is a diagram showing each voltage and hopping status of a toner in the image forming device in FIG. 22.

In the second embodiment of the printer as well, the phase adjuster adjusts the phases of the periodic pulse voltages for hopping such that a timing of turning on and off of the periodic pulse voltage for hoping and a timing of positioning the middle of the A phase electrode 33*a*Y and the B phase electrode with the center of the through-holes 14Y are synchronized as shown in FIG. 25. Thus, as shown in FIG. 24, a timing for most of hopping toners to reach a tidemark of the parabola and a timing for positioning the tidemark thereof with the center of the through-holes 14Y are synchronized.

Third Embodiment

Figure 26:
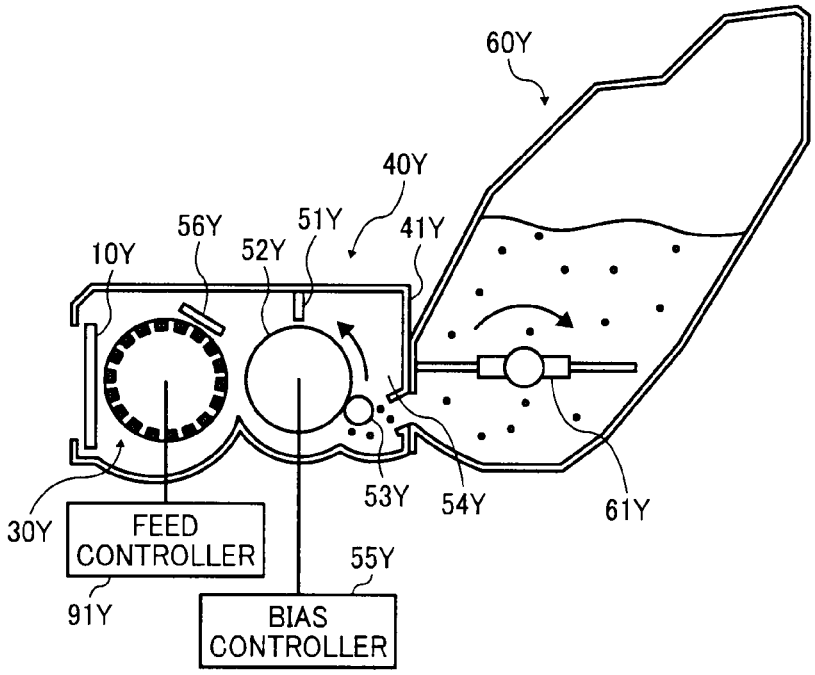
FIG. 26 is an amplified schematic view illustrating a configuration of a hopping unit for yellow of a third embodiment of the image forming apparatus of the present invention.

FIG. 26 is an amplified schematic view illustrating a configuration of a hopping unit for yellow 40Y of a third embodiment of the printer of the present invention. The hopping unit 40Y contains a toner alone instead of a mixed developer including a toner and a magnetic carrier. A roller formed of an elastic material of a rotating toner feed roller 52Y and a rotating charging roller 53Y contacting thereto sandwich a toner contained in a toner container to draw the toner by the surface of the toner feed roller 52Y while assisting frictionally charging the toner. After a layer thickness of the toner drawn by the toner feed roller 52Y is regulated by a regulation member 51Y contacting the toner feed roller 52Y, the toner is transferred to an area facing a toner bearing sleeve 30Y.

A bias controller 55Y applies a feed bias to the toner feed roller 52Y when printing. The feed bias has a polarity reverse to a polarity of a charged toner, which is larger than an average potential Vs of a pulse voltage applied to an A phase electrode and a B phase electrode of the toner bearing sleeve 30Y. An electric field is formed between the toner feed roller 52Y and the toner bearing sleeve 30Y to transfer a toner from the toner feed roller 52Y to the sleeve. A toner on the surface of the toner feed roller 52Y is transferred by the electric field from the surface of the roller to the surface of the sleeve. A flare is formed on the surface of the toner bearing sleeve 30Y with hopping toners as already mentioned. A part of the toner forming the flare is drawn into a through-hole of a circuit board 10Y to form a dot.

A toner which is not drawn into the through-hole of the circuit board 10Y at an area facing the circuit board 10Y comes into a casing with rotation of the toner bearing sleeve 30Y, and is collected by an unillustrated collector from the surface of the toner bearing sleeve 30Y. The collected toner is returned into a toner container.

A toner feeder 60Y is installed in a hopping unit 40Y from the side. A toner container of the hopping unit 40Y and the toner feeder 60Y are communicated with each other through a communication opening. The toner feeder 60Y has a rotatable toner feed member 61Y. The toner feed member 61Y has two flexibly deflectable blade members on a circumferential surface of its rotational axial member. When the toner feed member 61Y rotates buried in a toner contained in the toner feeder 60Y, the blade members of the toner feed member 61Y feed the toner to the communication opening, deflecting. Thus, the toner is fed into the toner container of the hopping unit 40Y. The toner container of the hopping unit 40Y includes an unillustrated toner detection sensor. When the toner detection sensor detects only a small amount of the toner, the toner feed member 61Y of the toner feeder 60Y is rotationally driven.

The structure of the hopping unit 40Y can be simplified more than the first embodiment.

Fourth Embodiment

Figure 27:
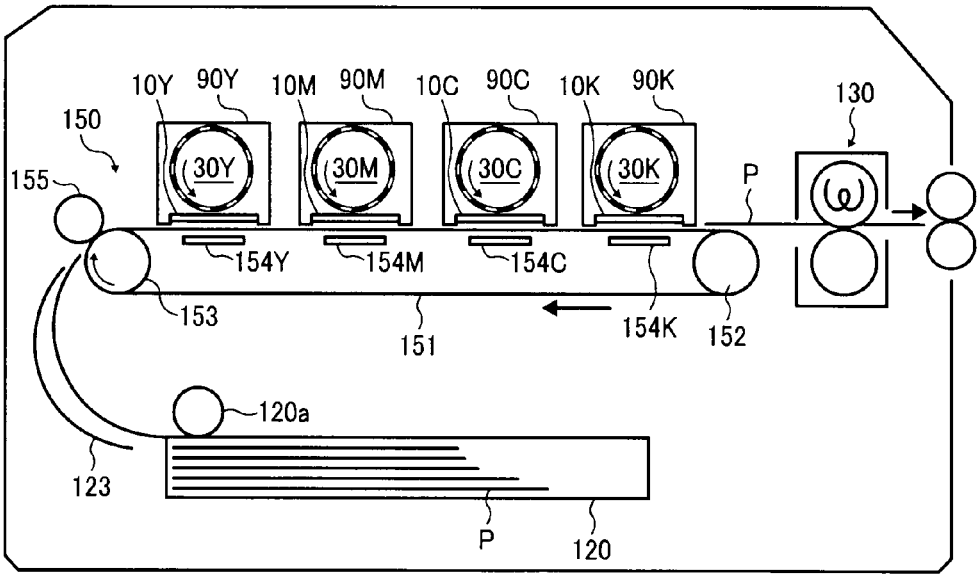
FIG. 27 is a schematic view illustrating a fourth embodiment of the image forming apparatus of the present invention.

FIG. 27 is a schematic view illustrating a fourth embodiment of the printer of the present invention. The printer has a record belt driver 150 different from that of the first embodiment. The record belt driver 150 transfers an endless paper feed belt 151 to adsorb a recording paper P onto the surface of the paper feed belt 151. With the endless transfer of the paper feed belt 151, a recording paper P sequentially passes positions facing image forming devices 90Y, 90M, 90C and 90K, for Y, M, C and K, respectively. Thus, a full-color toner image is formed on the recording paper P. Facing electrodes 154Y, 154M, 154C and 154K for Y, M, C and K, respectively are arrange inside a belt loop of the paper feed belt 151, and face circuit boards 10Y, 10*n*, 10C and 10K for Y, M, C and K, respectively through the belt. The paper feed belt 151 is formed of polyimide or the like and charged by a charger such as an unillustrated charging roller to adsorb the recording paper P on the surface of the belt.

With the endless transfer of the paper feed belt 151, the recording paper P transferred to a drive roller 152 where the belt is hung around separates from the paper feed belt 151 and comes into a fixer 130.

The recording paper P goes between the paper feed belt 151 and the circuit boards 10Y, 10*n*, 10C and 10K, and a distance therefrom to the belt is longer than that of the first embodiment. However, a transfer process is not needed and image deterioration due to the process can be avoided. In addition, a cleaner cleaning the belt can be omitted to reduce cost.

Fifth Embodiment

Figure 28:
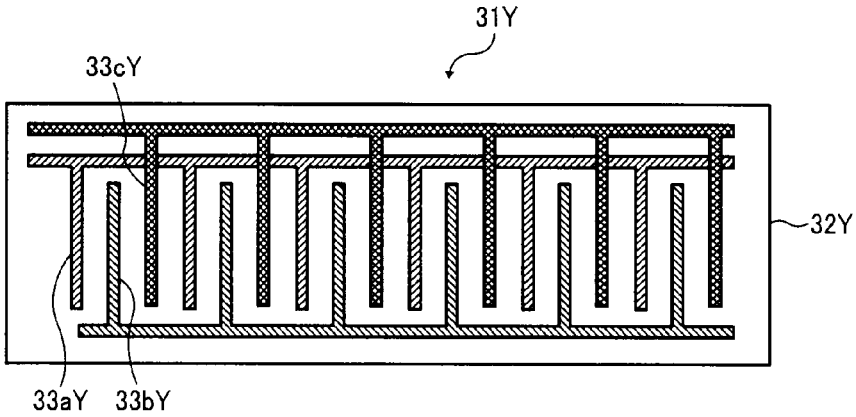
FIG. 28 is a plain development view illustrating a cylindrical part of a yellow toner bearing sleeve of a fifth embodiment of the image forming apparatus of the present invention.
Figure 29:
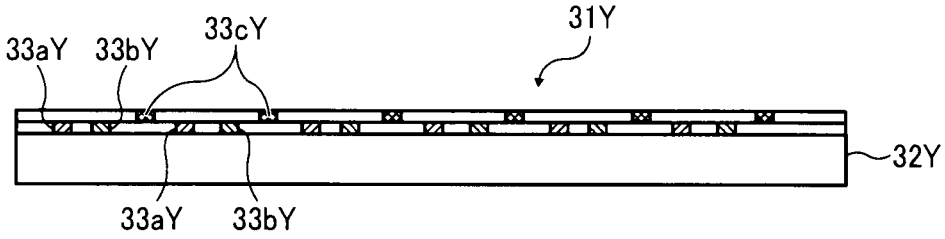
FIG. 29 is a cross-sectional view illustrating the cylindrical part in FIG. 28.

FIG. 28 is a plain development view illustrating a cylindrical part 31Y of a yellow toner bearing sleeve of a fifth embodiment of the printer of the present invention. FIG. 29 is a cross-sectional view illustrating the cylindrical part 31Y. Besides plural A phase electrodes 33*a*Y and B phase electrodes 33*by*, plural C phase electrodes 33*c*Y are lined along a circumferential direction of the sleeve. Combinations of the A phase, B phase and C phase are repeatedly lined. In a line direction of the hopping electrodes, a pitch of through-holes of a circuit board is an integral multiple of a toner hopping pitch as an arrangement pitch of the hopping electrodes.

Figure 30:
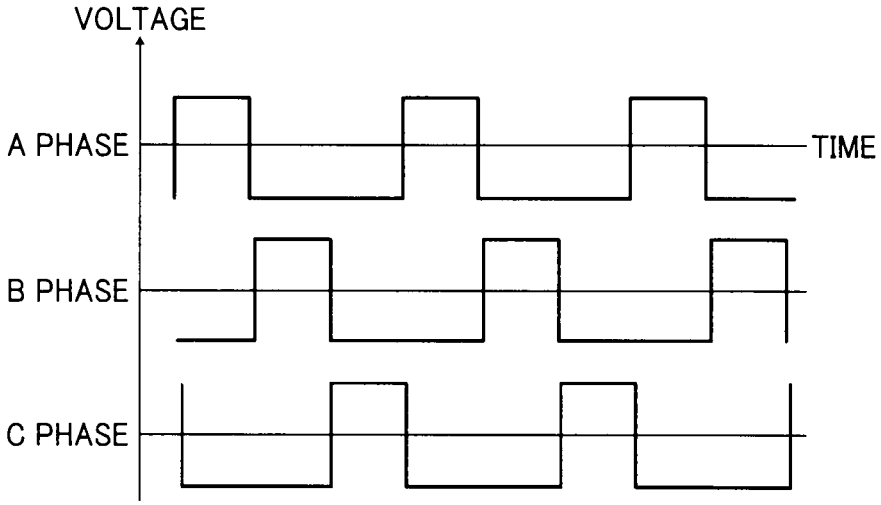
FIG. 30 is a diagram showing waveforms of an A phase hopping voltage applied to an A phase electrode, a B phase hopping voltage applied to a B phase electrode and a C phase pulse voltage applied to a C phase electrode of the cylindrical part in FIG. 28.

FIG. 30 is a diagram showing waveforms of an A phase hopping voltage applied to an A phase electrode 33*a*Y, a B phase hopping voltage applied to a B phase electrode 33*b*Y and a C phase pulse voltage applied to a C phase electrode 33*c*Y. The three pulse voltages have phase shifting relations with each other, but have the same peak-to-peak voltages and cycles. Application of such pulse voltages makes a toner on the surface of a toner bearing sleeve hop from the A, B and C phases. Thus, the toner orbits on the surface of the sleeve just by hopping. This eliminates the need for rotation of the toner bearing sleeve.

Sixth Embodiment

Figure 31:
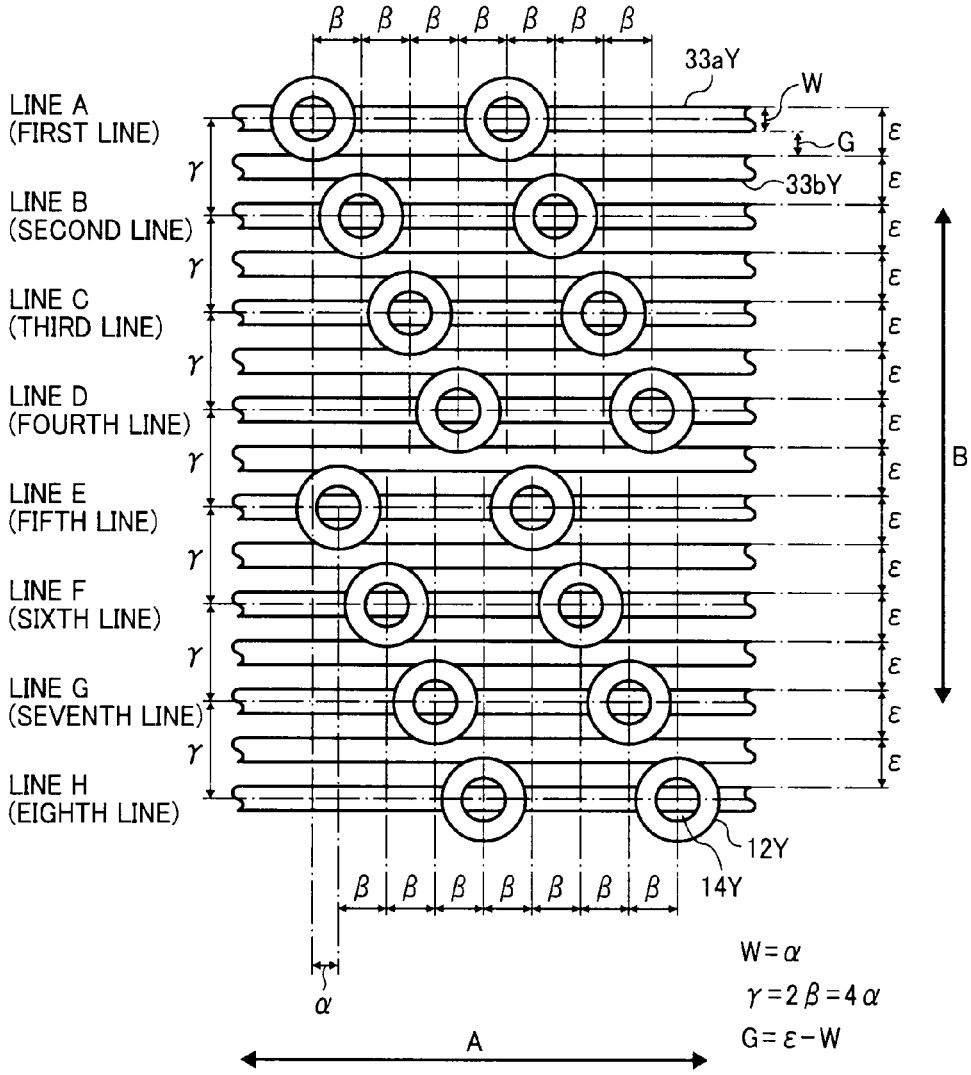
FIG. 31 is an amplified plain view illustrating a "hole-electrode combination" of a circuit board for yellow, and an A phase electrode and a B phase electrode of a sixth embodiment of the image forming apparatus.
Figure 50:
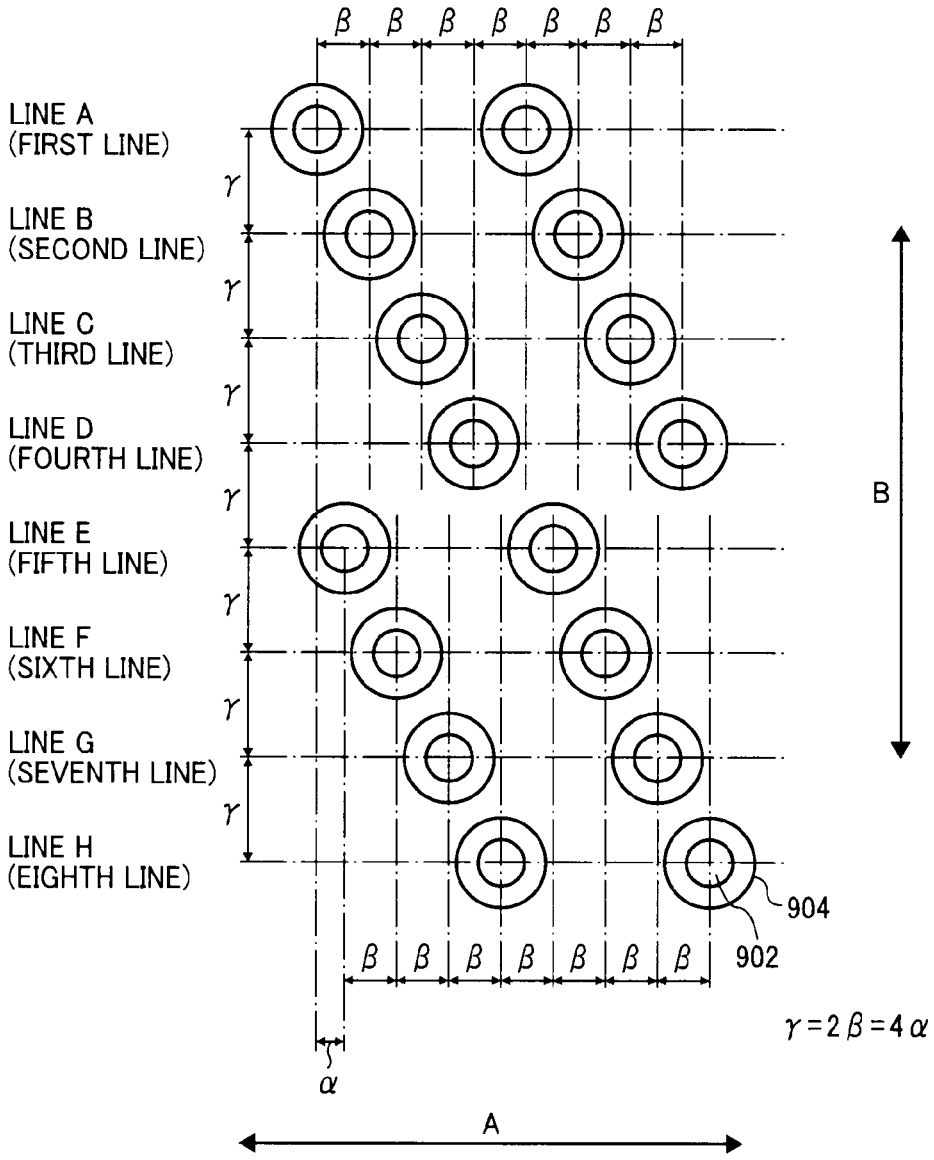
FIG. 50 is an amplified plain view illustrating a first embodiment of an arrangement of a fly control electrode.
Figure 51:
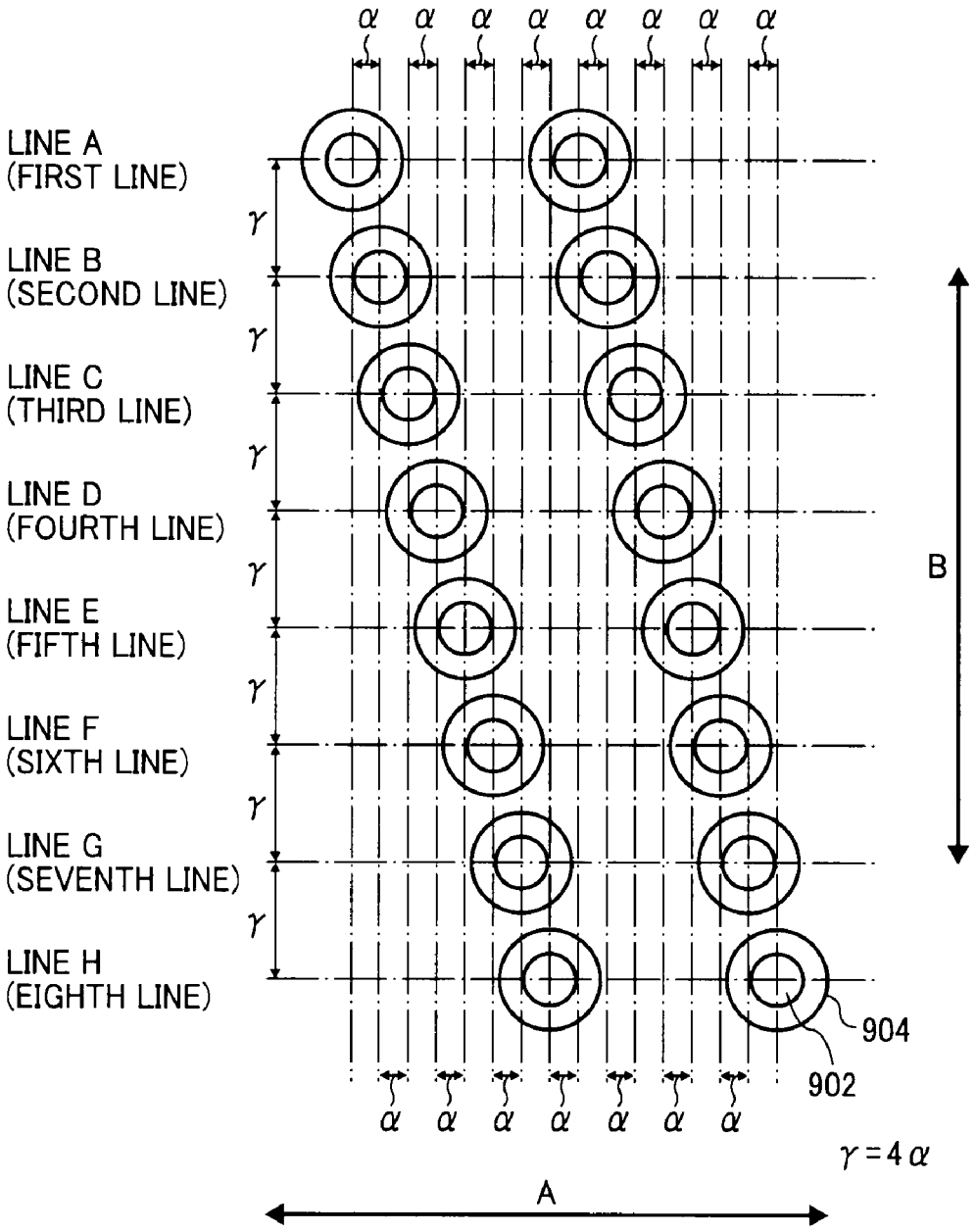
FIG. 51 is an amplified plain view illustrating a second embodiment of an arrangement of a fly control electrode.
Figure 52:
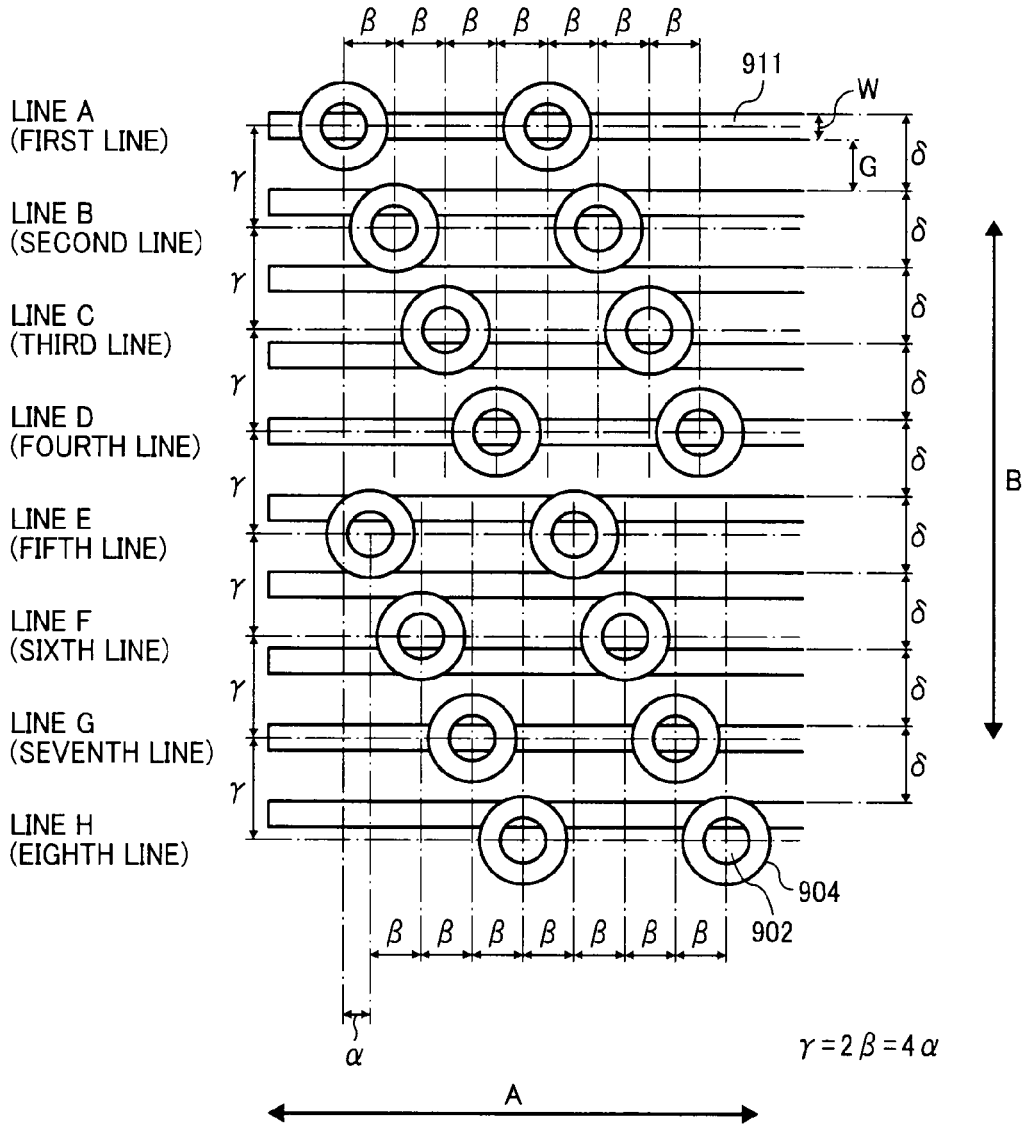
FIG. 52 is an amplified plain view illustrating a "hole-electrode combination" of the first embodiment of an arrangement of a fly control electrode in FIG. 50 with a hopping electrode of a toner bearing sleeve.

FIG. 31 is an amplified plain view illustrating a "hole-electrode combination" of a circuit board for yellow, and an A phase electrode and a B phase electrode of a sixth embodiment of the printer of the present invention. An arrow B indicates a feeding direction (=sub-scanning direction) of an unillustrated recording paper. An arrow A indicates a direction perpendicular to a feeding direction (=main scanning direction) of a recording paper. A circuit board for Y forms 8 lines from line A (first line) to line H (eighth line) of electrodes in a main scanning direction as the first embodiment in FIG. 50. A fly control electrode 12Y arranged in each line has a diameter of 300 μm. A through-hole 14Y having a diameter of 150 μm is formed at the center of the fly control electrode 12Y. In each electrode line, "hole-electrode combinations" including the fly control electrodes 12Y and the through-holes 14Y are lined at a pitch of "4×β" in a main scanning direction. β is 169.3 μm equivalent to a dot pitch to realize an image resolution of 150 dpi. From line A (first line) to line D (fourth line), the positions of "hole-electrode combinations" in a main scanning direction are shifted by β, respectively. A "hole-electrode combination" in line E (fifth line) is located between the "hole-electrode combination" in line A (first line) and a "hole-electrode combination" in line B (second line) in a main scanning direction. Similarly, a "hole-electrode combination" in line F (sixth line) is located between the "hole-electrode combination" in line B (second line) and a "hole-electrode combination" in line C (third line), a "hole-electrode combination" in line G (seventh line) is located between the "hole-electrode combination" in line C (third line) and a "hole-electrode combination" in line D (fourth line), and the "hole-electrode combination" in line H (eighth line) is located between the "hole-electrode combination" in line D (fourth line) and the "hole-electrode combination" in line E (fifth line), respectively. Thus, the 8 lines from line A to line H realize a dot pitch α=84.6 μm equivalent to an image resolution of 300 dpi. An arrangement pitch γ of electrode lines in a sub-scanning direction (an arrow B direction) is 4 times as long as α (=338.7 μm). Eight "hole-electrode combinations" per one line, i.e., 2,482/8=310 combinations are formed.

An A phase electrode 33*a*Y and a B phase electrode 33*by* of a toner bearing sleeve are extending in a main scanning direction. The electrodes have a width of 84.7 μm. The A phase electrode 33*a*Y and the B phase electrode 33*b*Y have a gap G of 84.7 μm between them. One of the plural A phase electrodes 33*a*Y is located just under a through-hole 14Y in line A. An alternate arrangement pitch ϵ of the A phase electrode 33*a*Y and the B phase electrode 33*b*Y is 169.4 μm equivalent to a half of γ, and each of the A phase electrodes 33*a*Y is located just under the through-hole 14Y in each line. As mentioned above, when the A phase electrode 33*a*Y and the B phase electrode 33*b*Y are alternately arranged, a toner has a hopping pitch almost equivalent to the alternate arrangement pitch ϵ 169.4 μm. The alternate arrangement pitch ϵ is half of the arrangement pitch γ of "hole-electrode combination" lines. Therefore, the arrangement pitch γ of "hole-electrode combination" lines is twice as long as the hoping pitch of a toner in a line direction of hopping electrodes. A toner hopping on the surface of a sleeve can locate tidemarks on its parabolic orbits at the respective centers of the plural through-holes.

Seventh Embodiment

Figure 32:
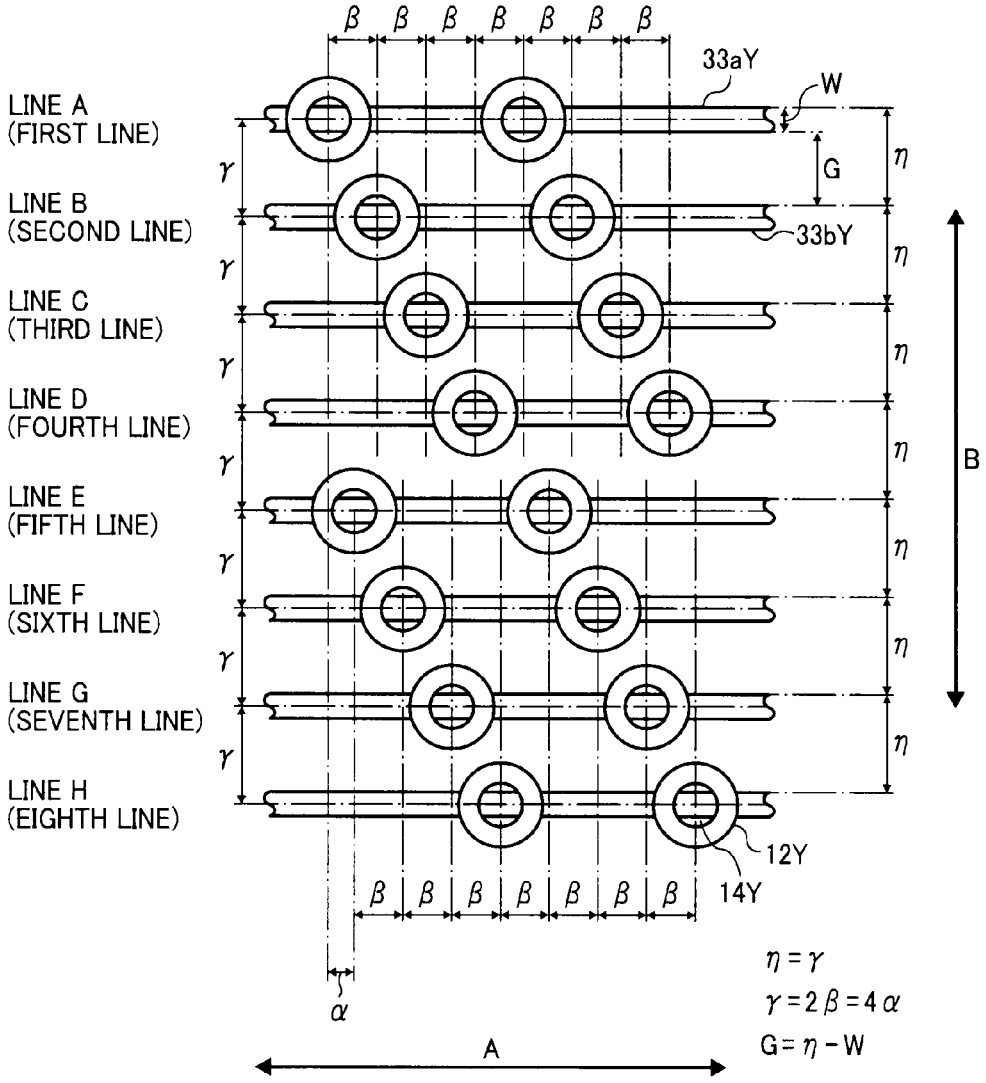
FIG. 32 is an amplified plain view illustrating a "hole-electrode combination" of a circuit board for yellow, an A phase electrode and a B phase electrode of a seventh embodiment of the image forming apparatus.

FIG. 32 is an amplified plain view illustrating a "hole-electrode combination" of a circuit board for Y, an A phase electrode and a B phase electrode of a seventh embodiment of the printer of the present invention. The circuit board for Y also forms 8 lines from line A (first line) to line H (eighth line) of electrodes in a main scanning direction as the first embodiment in FIG. 50. The 8 lines from line A to line H realize a dot pitch α=84.6 μm equivalent to an image resolution of 300 dpi. The "hole-electrode combination" has the same configuration as the sixth embodiment. The A phase electrode 33*a*Y and the B phase electrode 33*b*Y have a gap G of 238.7 μm between them. One of the plural A phase electrodes 33*a*Y is located just under a through-hole 14Y in line A. An alternate arrangement pitch η of the A phase electrode 33*a*Y and the B phase electrode 33*b*Y is 238.7 μm equivalent to γ, and each of the A phase electrodes 33*a*Y is located just under the through-hole 14Y in each odd-numbered line (line A, line C, line E and line G). Further, each of the B phase electrodes 33*b*Y is located just under the through-hole 14Y in each odd-numbered line (line B, line D, line F and line H). Therefore, the arrangement pitch γ of "hole-electrode combination" lines is one time as long as the hoping pitch of a toner in a line direction of hopping electrodes. A toner hopping on the surface of a sleeve can also locate tidemarks on its parabolic orbits at the respective centers of the plural through-holes.

Eighth Embodiment

Figure 33:
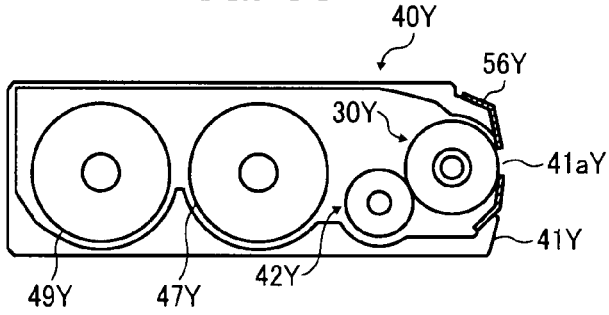
FIG. 33 is an amplified schematic view illustrating a configuration of a hopping unit for yellow of an eighth embodiment of the image forming apparatus of the present invention.

FIG. 33 is an amplified schematic view illustrating a configuration of a hopping unit for Y of an eighth embodiment of the printer of the present invention. A casing 41Y of a hopping unit 40Y has an opening 41*a*Y exposing a part of a circumferential surface of a toner bearing sleeve 30Y. A contact blade 56Y is fixed around the opening 41*a*Y.

Figure 34:
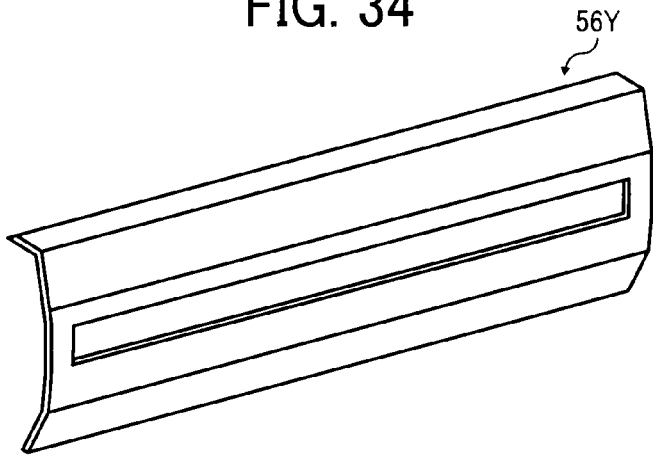
FIG. 34 is an amplified perspective view illustrating a contact blade of the hopping unit in FIG. 33.

FIG. 34 is an amplified perspective view illustrating the contact blade 56Y of the hopping unit 40Y. The contact blade 56Y has the shape of a letter U and a horizontally extending rectangular opening. This opening is communicated with the opening 41*a*Y of the hopping unit 40Y.

Figure 35:
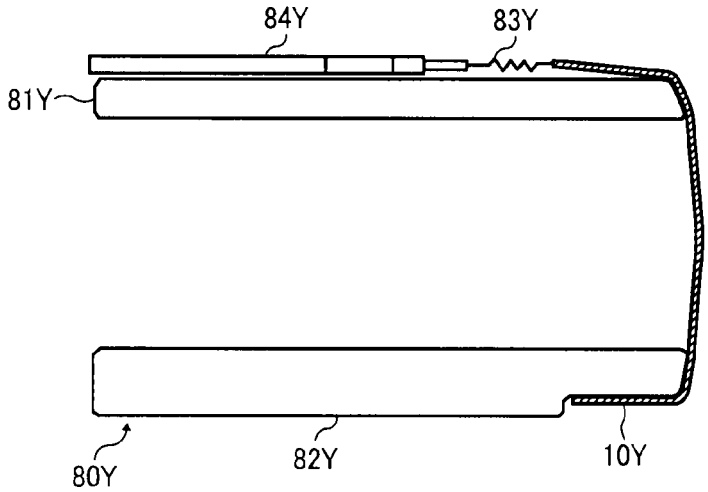
FIG. 35 is an amplified view illustrating a configuration of a unit holder for yellow in the image forming apparatus in FIG. 33.

FIG. 35 is an amplified view illustrating a configuration of a unit holder 80Y for Y in the printer of the eighth embodiment. The unit holder 80Y is installed in the hopping unit 40Y shown in FIG. 33 to form an image forming device for Y. The unit holder 80Y has an upper board 81Y and a lower board 82Y facing each other through a predetermined gap between them. The unit holder 80Y also has a suspension spring 83Y, a circuit board 10Y and a spring fixing board 84Y. The spring fixing board 84Y is fixed on the top surface of the upper board 81Y, and an end of the suspension spring 83Y formed of a coil spring is fixed at the end of the spring fixing board 84Y. The circuit board 10Y is formed of a flexibly deflectable flexible PC board. An end of the circuit board 10Y is fixed on the upper board 81Y. The suspension spring 83Y is connected with the other end. Thus, the circuit board 10Y formed of a flexible PC board is extensionally suspended between the lower board 82Y and the upper board 81Y. The suspension spring 83Y is located at a position such that the flexible circuit board 10Y is evenly extended between the lower board 82Y and the upper board 81Y. When there is only one suspension spring 83Y, it is connected with the center of a whole area of the circuit board 10Y in a direction perpendicular to a paper. When there are two, they are connected with an end and the other of the whole area, respectively. The hopping unit 40Y in FIG. 33 is inserted between the lower board 82Y and the upper board 81Y of the unit holder 80Y in FIG. 34.

Figure 36:
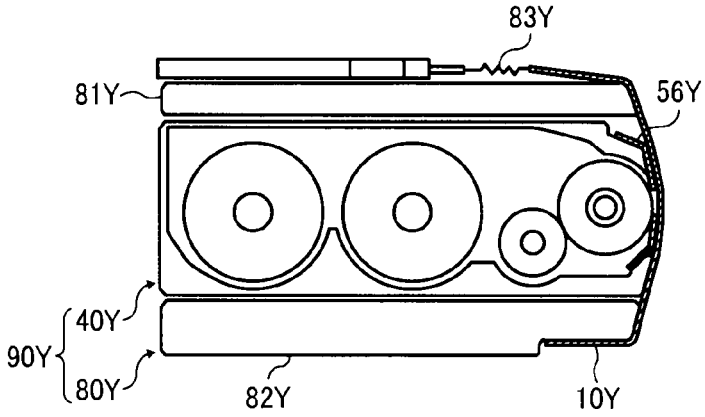
FIG. 36 is an amplified view illustrating a configuration of a yellow image forming device in the image forming apparatus in FIG. 33.

FIG. 36 is an amplified view illustrating a configuration of an image forming device 90Y in the eighth embodiment of the printer. The hopping unit 40Y inserted between the lower board contacts its contact blade 56Y to the 82Y and the upper board 81Y of the unit holder 80Y to the circuit board 10Y of the unit holder 80Y. Thus, the contact blade 56Y of the hopping unit 40Y closely contacts the circuit board 10Y of the unit holder 80Y.

When there is an error in a distance between the surface of the toner bearing sleeve 30Y and the circuit board 10Y, there is an error in an electric field intensity therebetween. When the circuit board 10Y has an assembly error, the distance has an error. However, in the eighth embodiment of the printer, when the contact blade 56Y of the hopping unit 40Y closely contacts the circuit board 10Y, the contact blade 56Y can precisely be located relative to the hopping unit 40Y in a direction from the toner bearing sleeve 30Y to the circuit board 10Y. Thus, the assembly error of the circuit board 10Y relative to the hopping unit 40Y can be resolved. The contact blade 56Y has a thickness such that the closest distance between the toner bearing sleeve 30Y and the circuit board 10Y is 300 μm, and is prepared by a method without uneven thickness.

The image forming device 90Y, in which the hopping unit 40Y is inserted into the unit holder 80Y, is detachable from the printer in a body. However, the hopping unit 40Y and the unit holder 80Y may separately be detachable.

Figure 37:
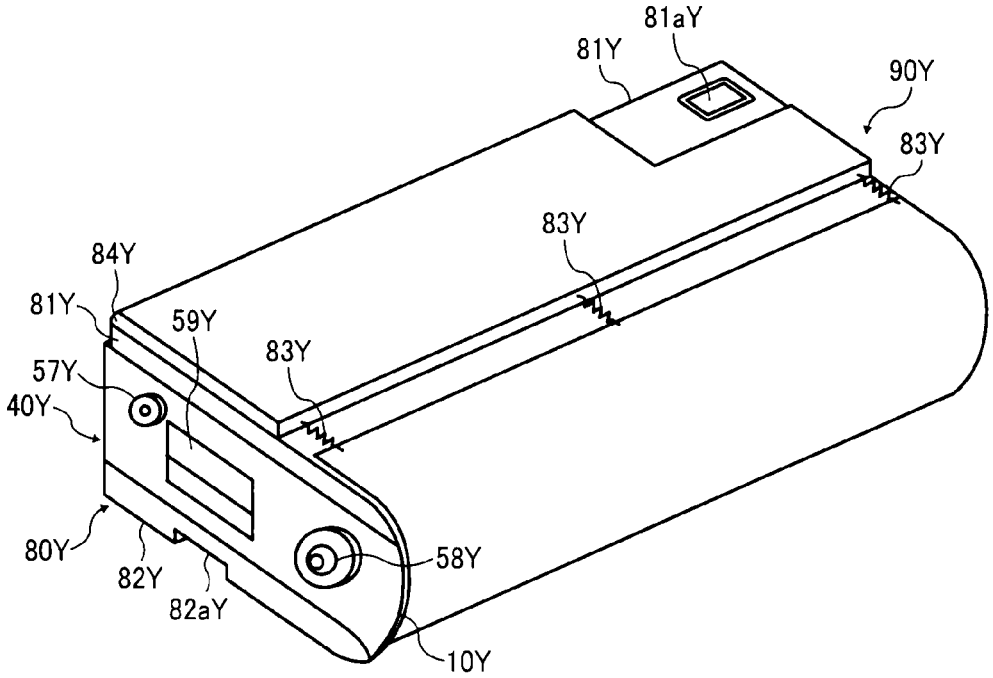
FIG. 37 is a perspective view illustrating the image forming device of the image forming apparatus in FIG. 33, seen from a side of a main scanning direction of the image forming device.
Figure 38:
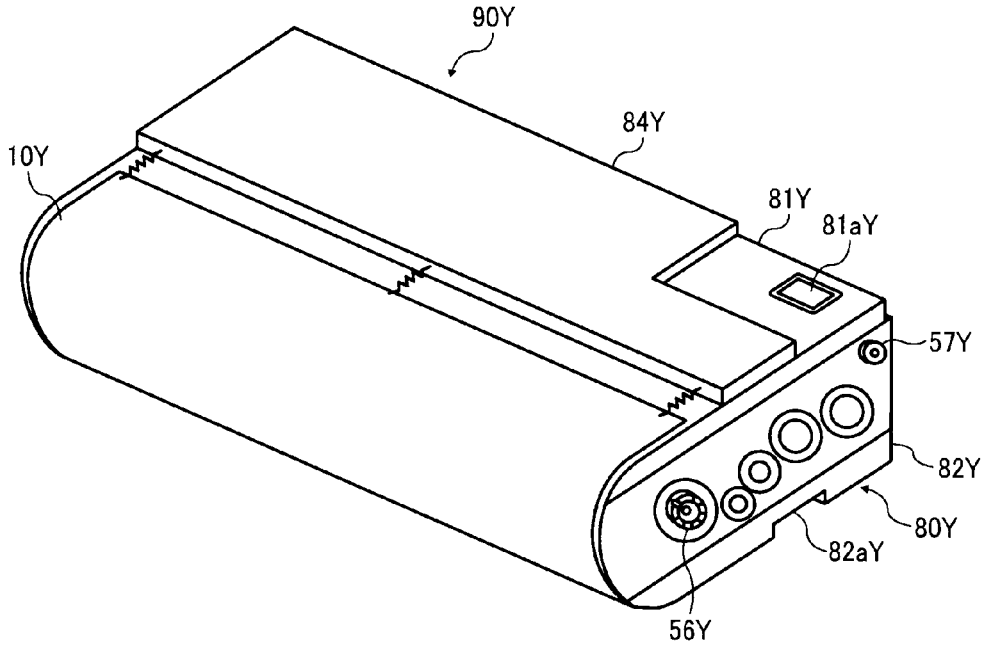
FIG. 38 is a perspective view illustrating the image forming device of the image forming apparatus in FIG. 33, seen from the other side of a main scanning direction of the image forming device.
Figure 39:
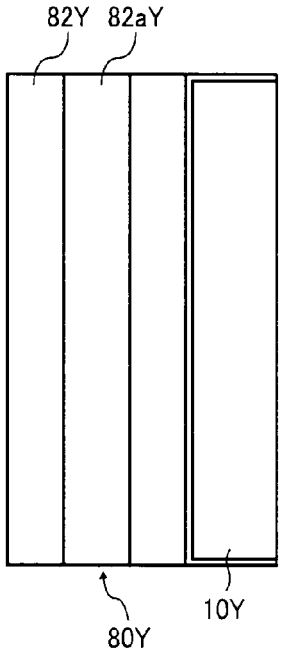
FIG. 39 is a plain view illustrating the image forming device of the image forming apparatus in FIG. 33, seen from the bottom.

FIG. 37 is a perspective view illustrating the image forming device 90Y for Y, seen from a side of a main scanning direction. FIG. 38 is a perspective view illustrating the image forming device 90Y for Y, seen from the other side of a main scanning direction. FIG. 39 is a plain view illustrating the image forming device 90Y for Y, seen from the bottom. A notch is formed at a corner of the spring fixing board 84Y of the unit holder 80Y. At the notch, the top surface of the upper board 81Y is exposed and a toner feed opening 81*a*Y is formed at the center thereof. There is a level difference between the top surface of the upper board 81Y exposed at the notch and that of the spring fixing board 84Y. The level difference is engageable with an unillustrated powder pump. The powder pump is connected with an unillustrated toner cartridge through an unillustrated feed pipe, and vacuums up a toner in the toner cartridge and feeds the toner into the hopping unit 40Y from the toner feed opening 81*a*Y. A notch is further formed on the upper board 81Y or the hopping unit 40Y is hollowed to have the shape of an emboss to enlarge the level difference more such that the powder pump is more included in the image forming device 90Y to save space. Instead of the powder pump and the toner cartridge, a toner feeder detachable from the image forming device 90Y such as the toner feeder 60Y in FIG. 16 may be formed such that a toner is fed into the hopping unit 40Y by free fall. The locations of the toner feed opening 81*a*Y are not limited to those in FIGS. 37 and 38, and are determined according to the inner configuration of the hopping unit 40Y.

As FIG. 38 shows, a coupling 56Y is rotatably formed on one of two side boards of the hopping unit 40Y. The coupling 56Y is engaged with a coupling of an illustrated driver of the printer and received a rotational drive force from the driver. Plural drive transmission gears directly or indirectly engaged with the coupling 56Y are formed on the other side board of the hopping unit 40Y. These drive transmission gears transmit drive forces to the toner bearing sleeve and many rotation members in the hopping unit 40Y. Further, a sub-standard locating member 57Y is formed on the side board projecting. The other end of both ends in a horizontal direction of the image forming device 90Y is mostly located when the coupling 56Y is engaged with the coupling of the printer. Namely, a main standard of locating at the other end is the coupling 56Y. At the other end, in addition to locating by the main standard, the sub-standard locating member 57Y is engaged with an unillustrated concave part of the printer for locating by the sub-standard.

As FIG. 37 shows, a sub-standard locating member 57Y is formed on the side board of another end as it is on the side board of the other end, and is engaged with an unillustrated concave part of the printer for locating by the sub-standard at the another end. A main standard locating member 58Y is formed projecting on the side board of the another end at the same position as the coupling 56Y is on the side board of the other end. At the another end, the main sub-standard locating member 58Y is engaged with an unillustrated concave part of the printer for locating by the main standard. The various drive transmission gears shown in FIG. 38 may be formed in the hopping unit 40Y. A handle 59Y is formed on the side board of the another end for an operator to handle.

As FIGS. 37, 38 and 39 show, a rail receiving groove 82*a*Y is formed extending over whole area in a main scanning direction on the lower board 82Y of the unit holder 80Y. The rail receiving groove 82*a*Y is engaged with an unillustrated slide rail of the printer to guide slide movement of the image forming device 90Y in the printer.

Figure 40:
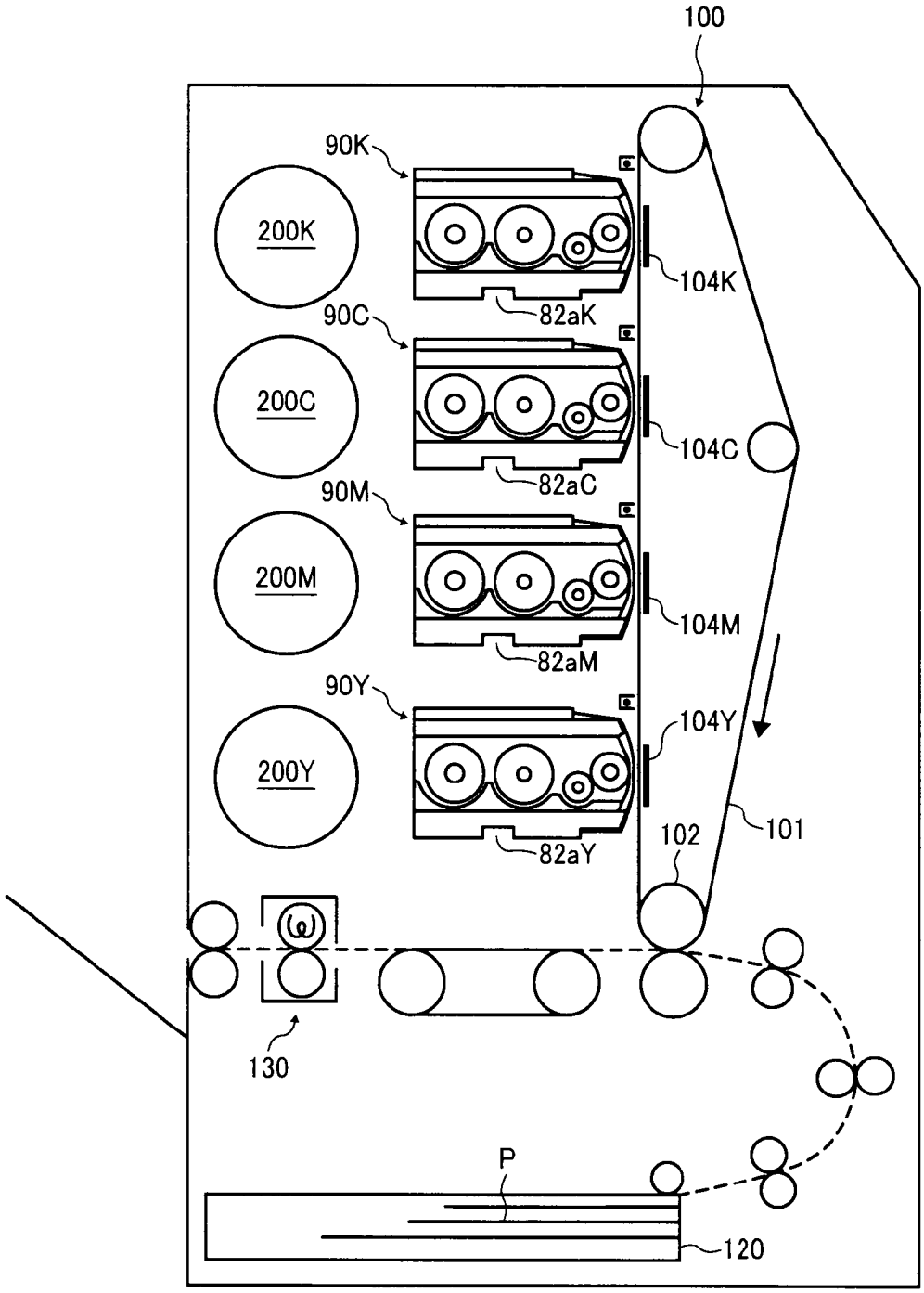
FIG. 40 is a schematic view illustrating the image forming apparatus in FIG. 33.

FIG. 40 is a schematic view illustrating the eighth embodiment of the printer of the present invention. An intermediate transfer belt 101 is vertically suspended. Image forming devices 90Y, 90M, 90C and 90K for Y, M, C and K are vertically lined along the intermediate transfer belt 101. An unillustrated door is located on the chassis of the printer, and the door is opened to expose devices in the chassis. The image forming devices 90Y, 90M, 90C and 90K engage the respective rail receiving grooves 82*a*Y, 82*a*M, 82*a*C and 82*a*K extending in a main scanning direction with unillustrated guide rails in the chassis. They are drawn along the guide rails to be taken out from the chassis. They are put in along the guide rails to be set in the chassis.

Toner cartridges 200Y, 200M, 200C and 200K for Y, M, C and K are located on the left side of the image forming devices 90Y, 90M, 90C and 90K. The toner cartridges are detachable by sliding.

Ninth Embodiment

A ninth embodiment is the same as the eighth embodiment unless otherwise specified in the following description.

Figure 41:
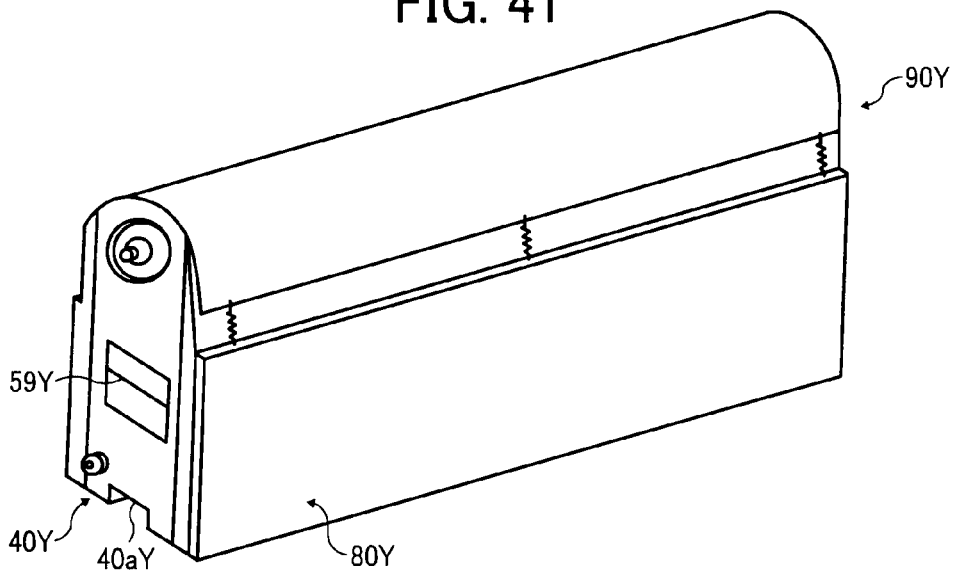
FIG. 41 is a perspective view illustrating a configuration of a yellow image forming device of a ninth embodiment of the image forming apparatus of the present invention, seen from a side of a main scanning direction of the image forming device.
Figure 42:
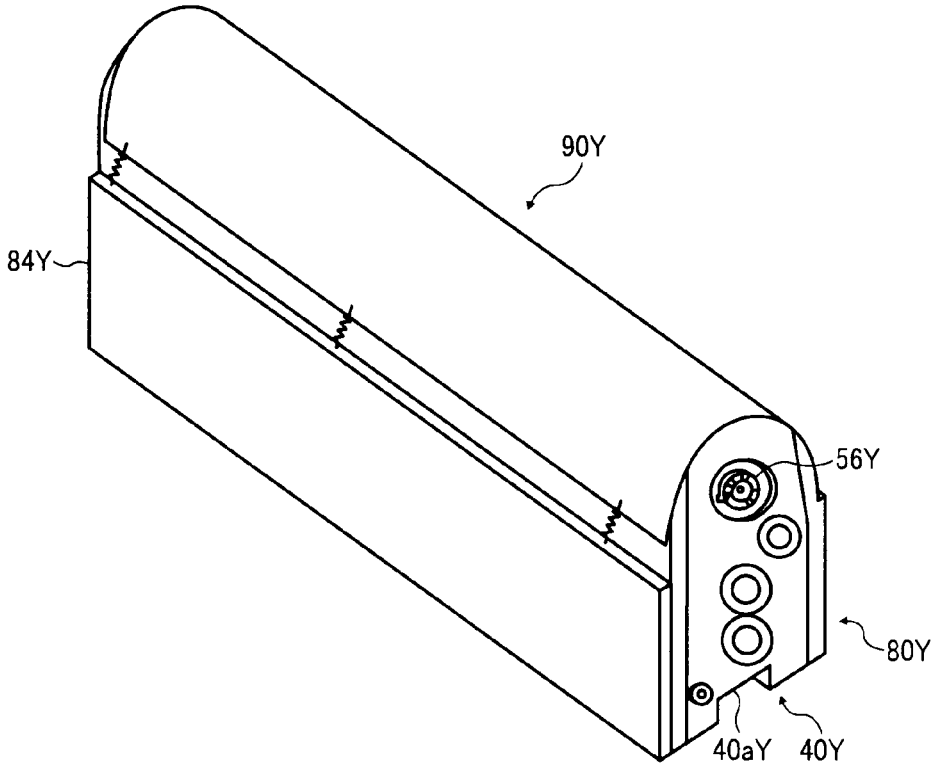
FIG. 42 is a perspective view illustrating the image forming device of the image forming apparatus in FIG. 41, seen from the other side of a main scanning direction of the image forming device.
Figure 43:
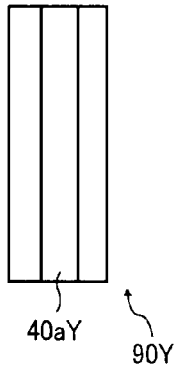
FIG. 43 is a plain view illustrating the image forming device of the image forming apparatus in FIG. 41, seen from the bottom.

FIG. 41 is a perspective view illustrating a configuration of a yellow image forming device 90Y for Y of the ninth embodiment of the printer of the present invention, seen from a side of a main scanning direction thereof. FIG. 42 is a perspective view illustrating the image forming device 90 Y for Y, seen from the other side of a main scanning direction thereof. FIG. 43 is a plain view illustrating the image forming device 90Y, seen from the bottom. A rail receiving groove 40*a*Y is formed not on a lower board of a unit holder 80Y, but on the hopping unit 40Y. The image forming device 90Y is set in the printer such that the rail receiving groove 40*a*Y looks downward as FIGS. 41 and 42 show.

Figure 44:
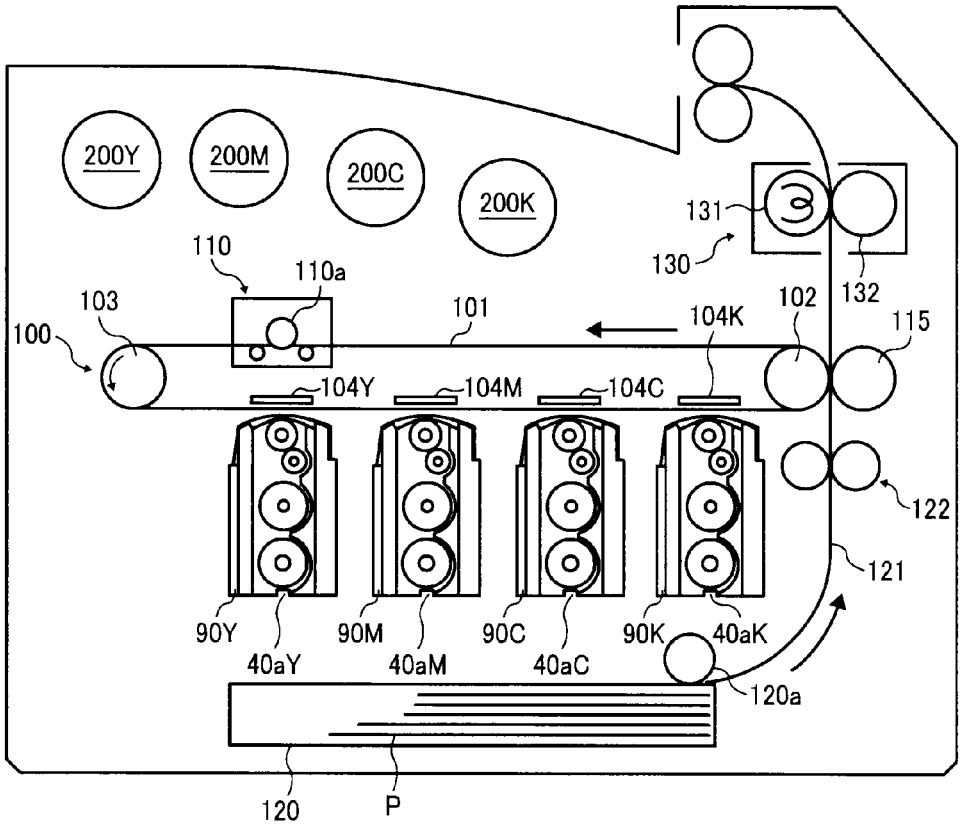
FIG. 44 is a schematic view illustrating the image forming apparatus in FIG. 41.

FIG. 44 is a schematic view illustrating the ninth embodiment of the printer. An intermediate transfer belt 101 is horizontally suspended. Image forming devices 90Y, 90M, 90C and 90K for Y, M, C and K are horizontally lined below the intermediate transfer belt 101. Image forming devices 90Y, 90M, 90C and 90K for Y, M, C and K are vertically lined along the intermediate transfer belt 101. An unillustrated door is located on the chassis of the printer, and the door is opened to expose devices in the chassis. The image forming devices 90Y, 90M, 90C and 90K engage the respective rail receiving grooves 82*a*Y, 82*a*M, 82*a*C and 82*a*K extending in a main scanning direction with unillustrated guide rails in the chassis. They are drawn along the guide rails to be taken out from the chassis. They are put in along the guide rails to be set in the chassis.

Tenth Embodiment

A tenth embodiment is the same as the eighth embodiment unless otherwise specified in the following description.

Figure 45:
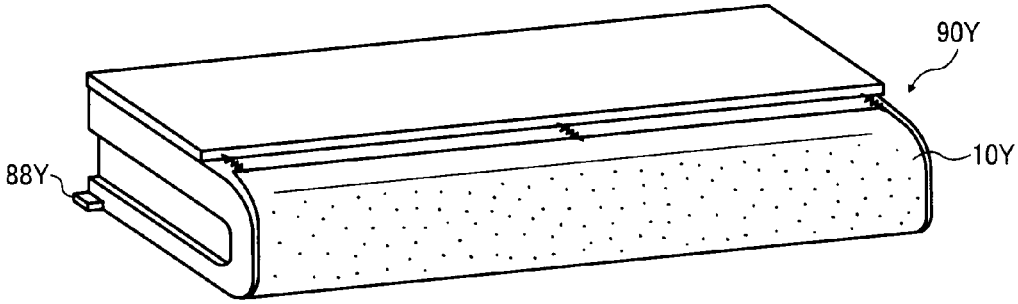
FIG. 45 is a perspective view illustrating a configuration of a yellow image forming device of a tenth embodiment of the image forming apparatus of the present invention, seen from a side of a main scanning direction of the image forming device.
Figure 46:
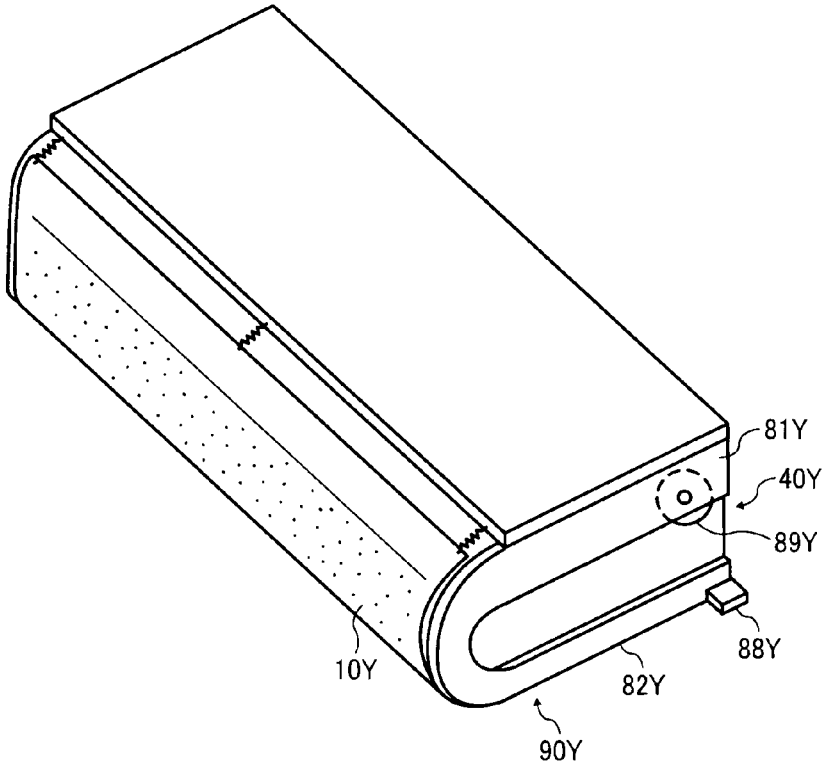
FIG. 46 is a perspective view illustrating the image forming device of the image forming apparatus in FIG. 45, seen from the other side of a main scanning direction of the image forming device.
Figure 47:
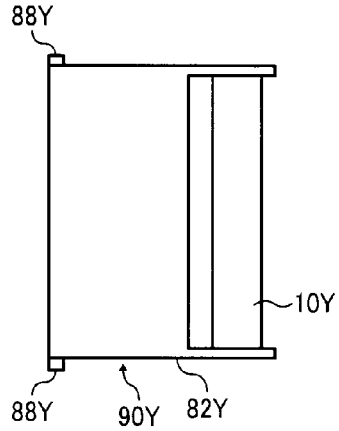
FIG. 47 is a plain view illustrating the image forming device of the image forming apparatus in FIG. 45, seen from the bottom.

FIG. 45 is a perspective view illustrating a configuration of an image forming device 90Y for Y of a tenth embodiment of the printer of the present invention, seen from a side of a main scanning direction of thereof. FIG. 46 is a perspective view illustrating the image forming device 90Y for Y of the printer, seen from the other side of a main scanning direction thereof. FIG. 47 is a plain view illustrating the image forming device 90Y, seen from the bottom. An upper board 81Y and a lower board 82Y of a unit holder are formed in a body. A hopping unit has a side surface in the unit holder. As FIG. 46 shows, the hopping unit 40Y does not have a coupling on its side surface but has a drive receiving gear 89Y instead. When the drive receiving gear 89Y is engaged with an unillustrated drive gear, the image forming device 90Y receives a drive force. The image forming device 90Y is located when main standard locating members 88Y formed on both side boards of the unit holder are respectively engaged with unillustrated concavities of the printer.

Figure 48:
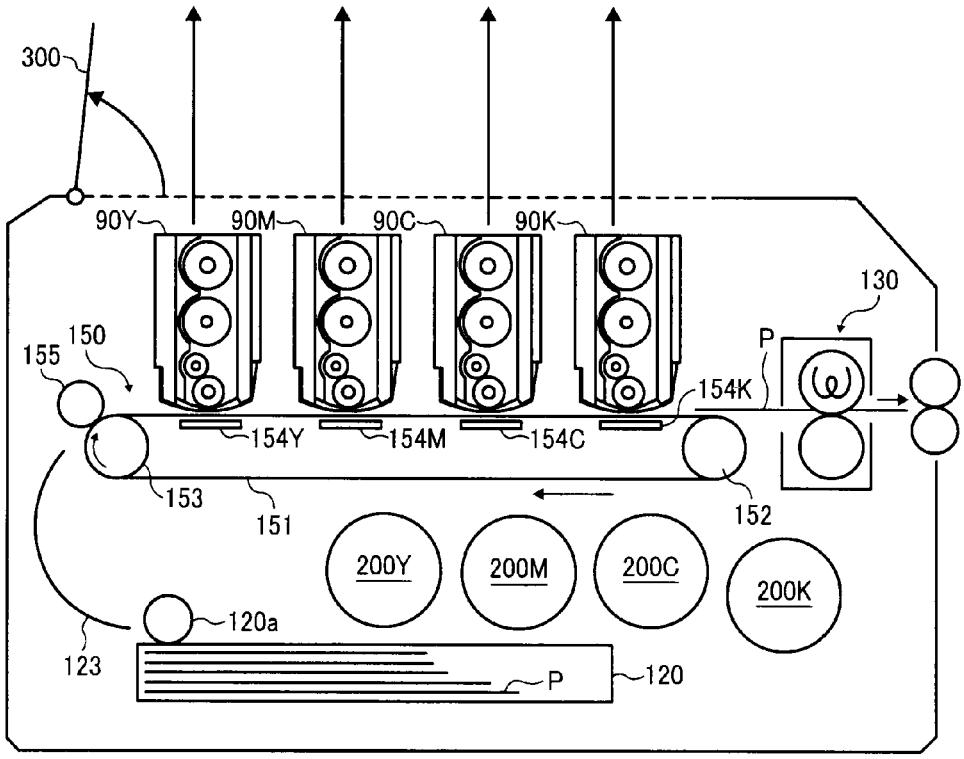
FIG. 48 is a schematic view illustrating the tenth embodiment of the image forming apparatus of the present invention.

FIG. 48 is a schematic view illustrating the tenth embodiment of the printer. An intermediate transfer belt 101 is horizontally suspended. Image forming devices 90Y, 90M, 90C and 90K for Y, M, C and K are horizontally lined above the intermediate transfer belt 101. A door 300 is located on the top surface of the chassis of the printer, and the door 300 is opened to expose devices in the chassis upward. The image forming devices 90Y, 90M, 90C and 90K are drawn upward as indicated by an arrow to be taken out from the chassis. They are set in the chassis when slid downward in a direction perpendicular to a main scanning direction.

Eleventh Embodiment

An eleventh embodiment is the same as the tenth embodiment unless otherwise specified in the following description.

Figure 49:
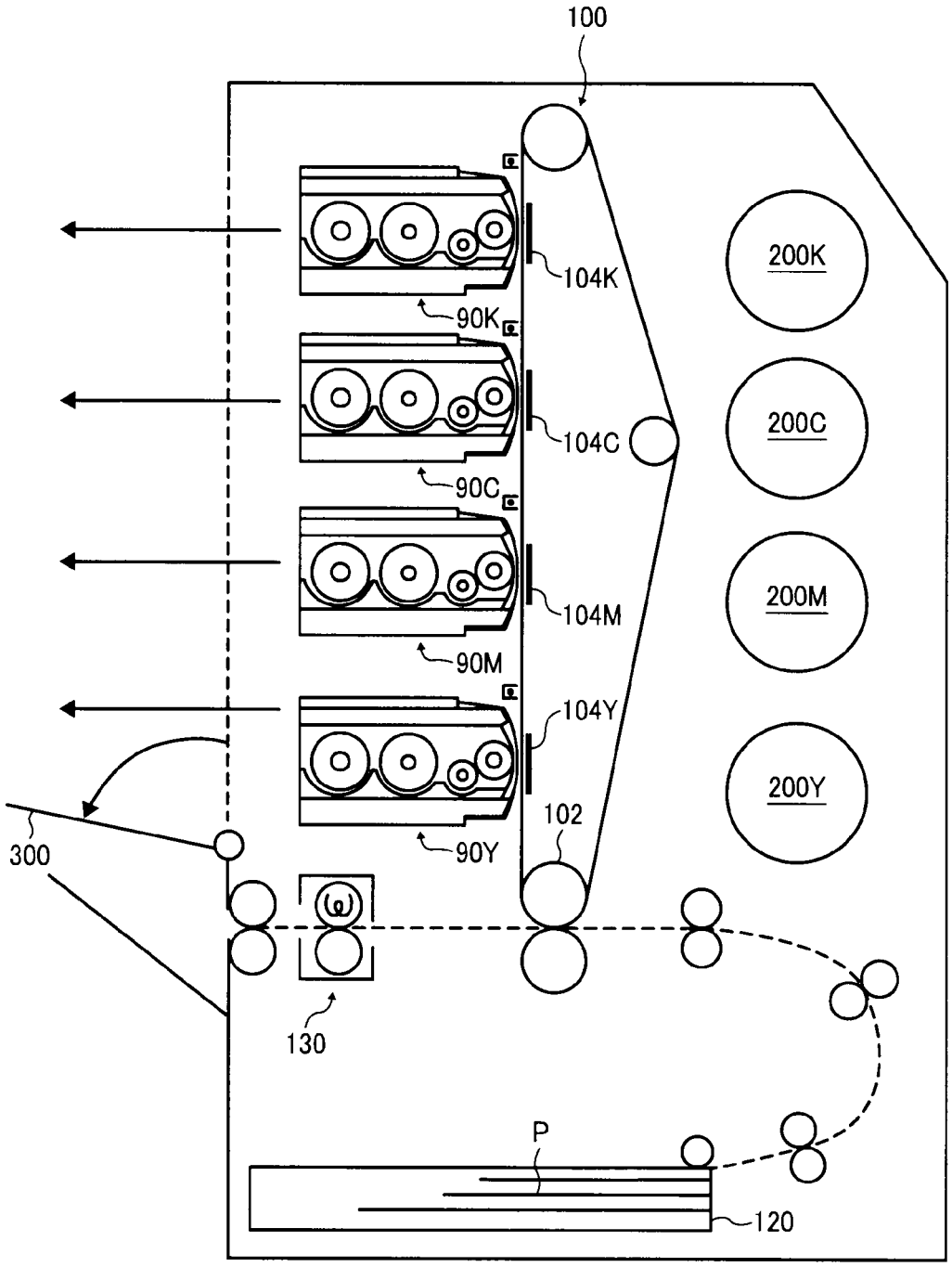
FIG. 49 is a schematic view illustrating an eleventh embodiment of the image forming apparatus of the present invention.

FIG. 49 is a schematic view illustrating the eleventh embodiment of the printer. An intermediate transfer belt 101 is vertically suspended. Image forming devices 90Y, 90M, 90C and 90K for Y, M, C and K are vertically lined on the left side of the intermediate transfer belt 101. A door 300 is located on the top surface of the chassis of the printer, and the door 300 is opened to laterally expose devices in the chassis. The image forming devices 90Y, 90M, 90C and 90K are laterally drawn to the left as indicated by an arrow to be taken out from the chassis. They are set in the chassis when slid to the right in a direction perpendicular to a main scanning direction.

The printer of the present invention has a record controller 28Y, i.e., a record voltage applicator, so as to synchronize timing of applying a record on voltage Vc-on with timing of turning on or off a periodic pulse voltage for hopping. The record on voltage Vc-on is applied at a timing for locating most of toners hopping from the A or B phase electrode at a tidemark of a parabola to feed a large amount of toners into the through-hole 14Y.

The printer of the present invention includes plural hopping electrodes including alternately-lined A phase electrodes 33*a*Y which are first hopping electrodes applied with A phase hopping periodic pulse voltages which are first periodic pulse voltages for hopping and B phase electrodes 33*b*Y which are second hopping electrodes applied with B phase hopping periodic pulse voltages which are second periodic pulse voltages for hopping, having an opposite phase waveform. A toner on the surface of the toner bearing sleeve 30Y reciprocates hopping between the A phase electrode 33*a*Y and the B phase electrode 33*b*Y lying adjacent to each other and transfers to an area facing the circuit board 10Y with surface movement of the toner bearing sleeve 30Y. Further, the printer includes a relative position detector grasping a relative position of the hopping electrode 33*a*Y or 33*b*Y of the toner bearing sleeve 30Y moving its surface to the through-hole 14Y of the circuit board 10Y, and a phase adjuster adjusting a phase of the periodic pulse voltages for hopping. As mentioned already, a timing for most of hopping toners to reach tidemark of a parabola and a timing for positioning the center of the parabola with the center of the through-hole 14Y are synchronized to feed a large amount of toners into the through-hole 14Y.

The fourth embodiment of the printer record a dot on a sheet-shaped recording paper fed on the surfaces of the facing electrodes 154Y, 154M, 154C and 154K by transferring a toner having passed an image hole to the recording paper. A transfer process is not needed and image deterioration therein can be avoided. In addition, a cleaner cleaning a belt can be omitted to save cost.

Further, the printer of the present invention records a dot on an endless intermediate belt 101 passing the surface of the facing electrode 104 while endlessly moving along an endless orbit by transferring a toner having passed an image hole to the recording paper, and transfers the dot onto a recording paper. The intermediate belt 101 is formed of a material having relatively a small reflection coefficient and prevents a toner having reached the surface of the belt after passing the image hole from rebounding to prevent background fouling.

The printer of the present invention includes plural image forming means including a circuit board, a toner bearing sleeve and a facing electrode, and the respective image forming means record dots different from each other. Thus, a multicolor image can be formed.

This application claims priority and contains subject matter related to Japanese Patent Applications Nos. 2009-190579 and 2010-131029, filed on Aug. 20, 2009, and Jun. 8, 2010, respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming device, comprising:

a toner bearer including plural linear electrodes aligned at a first regular pitch in a crosswise direction of the toner bearer, configured to cause toner to fly along the surface of the toner bearer between the plural linear electrodes upon application of a pulse voltage thereto to form a floating toner layer; and a substrate including plural hole-electrode combinations arranged in a longitudinal direction of the linear electrodes, each formed of a through-hole and a hole-adjacent electrode located close to the through-hole, wherein the floating toner layer is formed in an area facing the through-hole, and toner passes through only the through-holes facing a desired image from the floating toner layer upon application of a record-on voltage for recording a dot or a record-off voltage for not recording a dot, and wherein the plural hole-electrode combinations arranged in a longitudinal direction of the linear electrodes are arranged in lines at a second regular pitch in a crosswise direction of the toner bearer, and the second regular pitch is an integral multiple of the first regular pitch.

2. The image forming device of claim 1, wherein the plural linear electrodes comprise first linear electrodes supplied with a first pulse voltage and second linear electrodes supplied with a second pulse voltage having a phase opposite that of the first pulse voltage, and wherein the first linear electrodes and the second linear electrodes are alternately arranged in the crosswise direction.

3. The image forming device of claim 2, further comprising third linear electrodes supplied with a third pulse voltage having a phase different from those of the first and the second pulse voltages, wherein a combination of the first, the second, and the third linear electrodes is repeatedly arranged in line, and wherein the second and the third pulse voltages rise and fall to be supplied to the respective linear electrodes while the first pulse voltage rise or falls to be supplied to the first linear electrodes.

4. The image forming device of claim 1, satisfying the following relationship:

$$\theta<\tan^{-1}(D/L)$$

wherein θ is an angle between a longitudinal direction of the linear electrodes of the toner bearer and an arrangement direction in which the hole-electrode combinations of the substrate are arranged; D represents a diameter of the through-hole; and L represents a distance between centers of through-holes located at opposite ends of the hole-electrode combinations in the arrangement direction.

5. The image forming device of claim 1, wherein the image forming device is detachable from an image forming apparatus together with at least the toner bearer and the substrate.

6. The image forming device of claim 1, further comprising a toner feeder comprising a magnetic brush on its surface, configured to frictionally contact the top of the magnetic brush to which toner is adsorbed with the toner bearer in a toner feeding area facing the toner bearer to feed the toner to the toner bearer.

7. An image forming device, comprising:

a toner bearer, comprising:

plural linear electrodes aligned at a first regular pitch in a crosswise direction of the toner bearer;

a surface electrode disposed in a longitudinal direction; and an insulative layer located between the linear electrodes and the surface electrode, the toner bearer configured to cause toner to fly along the surface thereof upon application of pulse voltages having phases opposite to each other to the linear electrodes and the surface electrode to form a floating toner layer; and a substrate comprising plural hole-electrode combinations, each formed of a through-hole and a hole-adjacent electrode located close to the through-hole, wherein the floating toner layer is formed in an area facing the through-hole, and toner passes through only the through-holes facing a desired image from the floating toner layer upon application of a record-on voltage for recording a dot or a record-off voltage for not recording a dot, and wherein the plural hole-electrode combinations arranged in a longitudinal direction of the linear electrodes are lined at a second regular pitch in a crosswise direction of the toner bearer, and the second regular pitch is an integral multiple of the first regular pitch.

8. The image forming device of claim 7, satisfying the following relationship:

$$\theta<\tan^{-1}(D/L)$$

wherein θ is an angle between a longitudinal direction of the linear electrodes of the toner bearer and an arrangement direction of the hole-electrode combinations of the substrate; D represents a diameter of the through-hole; and L represents a distance between centers of through-holes located at opposite ends of the hole-electrode combinations in the arrangement direction.

9. The image forming device of claim 7, wherein the image forming device is detachable from an image forming apparatus together with at least the toner bearer and the substrate.

10. The image forming device of claim 7, further comprising a toner feeder comprising a magnetic brush on its surface, configured to frictionally contact the top of the magnetic brush to which toner is adsorbed with the toner bearer in a toner feeding area facing the toner bearer to feed the toner to the toner bearer.

11. An image forming apparatus, comprising:

a feeder configured to feed a recording medium;

a transporter configured to transport the recording medium;

an image forming device configured to form a tone image on an intermediate transferer or the recording medium; and a fixer configured to fix the toner image on the recording medium, wherein the image forming device comprises:

a toner bearer, comprising:

plural linear electrodes located at a first regular pitch in a crosswise direction of the toner bearer; and a surface electrode in a longitudinal direction; and an insulative layer located between the linear electrodes and the surface electrode, the toner bearer configured to cause toner to fly along the surface thereof upon application of pulse voltages having phases opposite to each other to the linear electrodes and the surface electrode to form a floating toner layer; and a substrate comprising plural hole-electrode combinations, each formed of a through-hole and a hole-adjacent electrode located close to the through-hole, wherein the floating toner layer is formed in an area facing the through-hole, and a toner passes through only the through-holes facing a desired image from the floating toner layer upon application of a record-on voltage for recording a dot or a record-off voltage for not recording a dot, and wherein the plural hole-electrode combinations arranged in a longitudinal direction of the linear electrodes are lined at a second regular pitch in a crosswise direction of the toner bearer, and the second regular pitch is an integral multiple of the first regular pitch.

12. The image forming apparatus of claim 11, further comprising an electrode facing the substrate through an image forming surface of the intermediate transferer or the recording medium, configured to form an electric field at the image forming surface side.

13. The image forming apparatus of claim 11, further comprising a fly voltage applicator configured to apply respective pulse voltages to the linear electrodes and the surface electrode to form an electric field on the surface of the toner bearer to cause the toner to fly.

14. The image forming apparatus of claim 11, further comprising:

a relative position detector configured to grasp a relative position of the linear electrode of the toner bearer moving its surface relative to the hole-electrode combination; and a phase adjuster configured to adjust respective phases of the pulse voltage applied to the linear electrode and the pulse voltage applied to the surface electrode.

15. The image forming apparatus of claim 11, satisfying the following relationship:

$$\theta<\tan^{-1}(D/L)$$

wherein θ is an angle between a longitudinal direction of the linear electrodes of the toner bearer and an arrangement direction of the hole-electrode combinations of the substrate; D represents a diameter of the through-hole; and L represents a distance between centers of through-holes located at opposite ends of the hole-electrode combinations in the arrangement direction.

16. The image forming apparatus of claim 11, further comprising a toner feeder comprising a magnetic brush on its surface, configured to frictionally contact the top of the magnetic brush to which toner is adsorbed with the toner bearer in a toner feeding area facing the toner bearer to feed the toner to the toner bearer.

17. The image forming apparatus of claim 11, wherein a timing of starting application of the record-on voltage is synchronized with a timing of rise or fall of the pulse voltage.

* * * * *